US005213953A

United States Patent [19]

Yamamoto

[11] Patent Number: 5,213,953

[45] Date of Patent: May 25, 1993

[54] COLOR IMAGE FORMING PROCESS

[75] Inventor: Soichiro Yamamoto, Kanagawa, Japan

[73] Assignee: Fuji Photo Film Co., Ltd., Kanagawa, Japan

[21] Appl. No.: 727,169

[22] Filed: Jul. 9, 1991

[30] Foreign Application Priority Data

Jul. 10, 1990 [JP] Japan ..... 2-180529

[51] Int. Cl.[5] ..... G03C 7/46

[52] U.S. Cl. ..... 430/383; 430/403; 430/505; 430/567; 430/569; 430/604; 430/605; 430/608

[58] Field of Search ..... 430/383, 403, 435, 505, 430/567, 569, 604, 605, 608

[56] References Cited

U.S. PATENT DOCUMENTS 5,057,402 10/1991 Shiba et al. ..... 430/567
5,116,721 5/1992 Yamamoto ..... 430/351

FOREIGN PATENT DOCUMENTS 423765 4/1991 European Pat. Off. ..... 430/604
3-188437 8/1991 Japan ..... 430/604

*Primary Examiner*—Charles L. Bowers, Jr.
*Assistant Examiner*—Janet C. Baxter
*Attorney, Agent, or Firm*—Sughrue, Mion, Zinn, Macpeak & Seas

[57] ABSTRACT

A color image forming process is disclosed. The process comprises color developing an imagewise exposed silver halide color photographic material with a developer containing an aromatic primary amine color developing agent, after successive steps of desilvering, washing and/or stabilizing, and drying, wherein said color photographic material has at least one silver halide emulsion layer containing silver halide grains containing substantially no silver iodide and containing at least 95 mol % silver chloride based on the total silver halide content, said silver halide grains further containing from $1\times10^{-6}$ to $1\times10^{-3}$ mol of an iron compound per mol of silver and said iron compound being distributed at an iron ion concentration in the surface phase of the grain of at least 5 times that in the inside phase of the grain, wherein the total gelatin weight of said color photographic material is 7 g or less per $m^2$ of photographic material, and wherein in the color development step, the color photographic material is processed for a time of from 5 seconds to 30 seconds while striking the surface of light-sensitive layer of said color photographic material with jet streams of a color development processing solution. The process can stably produce excellent color images having less image unevenness even in photographic processing of a very short processing time.

18 Claims, 1 Drawing Sheet

COLOR IMAGE FORMING PROCESS

FIELD OF THE INVENTION

The present invention relates to a color image forming process using a silver halide color photographic material. More particularly, the present invention relates to a color image forming process capable of stably producing excellent color images having less image unevenness even in photographic processing of a very short processing time.

BACKGROUND OF THE INVENTION

A process of developing image-exposed silver halide grains using an aromatic primary amine compound as a color developing agent and forming color images by coupling the oxidation product of the color developing agent formed thereby with color couplers is a conventionally known technique which has been widely utilized in silver salt photography.

One of important themes in the photographic field is to improve productivity in the laboratory and to shorten the waiting time for customers to receive photographic processing of color photographic materials as quickly as possible.

The easiest process for quickly carrying out photographic processing of photographic light-sensitive materials is to activate the reaction by increasing the processing temperature, and great shortening of the processing time has already been achieved by this practice.

On the other hand, recently, many inventions relating to techniques for carrying out quick processing using silver halide grains having a high content of silver chloride are proposed, e.g., in JP-A-58-95345, JP-A-59-232342, and JP-A-60-19140 (the term "JP-A" as used herein means an "unexamined published Japanese patent application").

By using the high silver chloride content silver halide grains, color development processing time, which has hitherto been required to be longer than 3 minutes, can be shortened below 1 minute. But it has been found that when it is intended to further shorten the processing time below 30 seconds, the quality of color images is likely to be reduced and, in particular, image unevenness is likely to occur.

Also, as a process for quickly carrying out a development process, a technique of using a color development accelerator (as described, e.g., in JP-A-53-15831, JP-A-55-62450, JP-A-55-62451, JP-A-55-62452, JP-A-55-52453, JP-B-51-12422, and JP-B-55-49728) (the term "JP-B" as used herein means an "examined Japanese patent publication") and a technique of using a so-called auxiliary developing agent such as 3-pyrazolidone, etc., are known. But the photographic light-sensitive materials using the auxiliary developing agent have the disadvantage that storage stability is insufficient.

On the other hand, JP-A-51-139323, JP-A-59-171947, and British Patent 2,109,576A disclose that by incorporating a compound of a metal belonging to Group VIII of the Periodic Table in a photographic light-sensitive material, a high sensitivity is obtained and also reciprocity law failure is improved.

Also, JP-B-49-33781, JP-A-50-23618, JP-A-52-18310, JP-A-58-15952, JP-A-59-214028, JP-A-61-67845, German Patents 2,226,877 and 2,708,466, and U.S. Pat. No. 3,703,584 disclose that by incorporating a rhodium compound or an iridium compound in a photographic light-sensitive material, an increase in contrast and improvement in reciprocity law failure are attained. However, there is no description of the stability with the foregoing very quick photographic processing in the above publications.

Similarly, U.S. Pat. No. 4,269,927 discloses that by incorporating cadmium, lead, copper, zinc or a mixture thereof in the inside of the silver halide grains of a surface latent image-type high silver chloride emulsion having a silver halide content of at least 80 mol %, a high sensitivity is obtained. Also, JP-B-48-35373 discloses that by incorporating a water-soluble iron compound in a silver chloride emulsion obtained by a successive mixing method, a black and white photographic paper having a high contrast is obtained at a low cost. Furthermore, JP-A-1-18364 discloses the technique of obtaining a high sensitivity and further reducing the sensitivity deviation due to the temperature change at light exposure by locating silver bromide-localized phases on the inside or the surface of silver halide grains of a high silver chloride content emulsion containing iron ions.

However, there is no disclosure regarding the stability in the foregoing very quick photographic processes described in the above publications.

In such circumstances, it has been found that when color development is carried out in a very short time of not longer than 30 seconds, it appears that the time dependence of the development progress becomes large, whereby a local unevenness is likely to be caused in the color density and good color images can not stably obtained. It shall be noticed that the problem being solved is the developability of silver halide grains in the very early stage, but there is no solution to the problem from a practical point of view.

SUMMARY OF THE INVENTION

One object of the present invention is to provide an image forming process capable of stably forming preferred color images when developing a color photographic material in a very short time.

A second object of the present invention is to provide an image forming process wherein the color development rapidly proceeds to saturation and the time dependence of the color density before and after a definite development time is less (hereinafter, the foregoing matter is referred to as "the development progressing character is good"), which results in stable color images having less uneven density.

As the result of various investigations to attain the foregoing objects, it has been discovered that the foregoing objects can be attained by the present invention as described below.

(1) A color image forming process by color developing an imagewise exposed silver halide color photographic material with a developer containing an aromatic primary amine color developing agent, after the successive steps of desilvering (blixing), washing and/or stabilizing, and drying. The color photographic material has at least one silver halide emulsion layer containing silver halide grains containing substantially no silver iodide and containing at least 95 mol % silver chloride based on the total silver halide content. The silver halide grains further contain from $1\times10^{-6}$ to $1\times10^{-3}$ mol of an iron compound per mol of silver, and the iron compound is distributed at an iron ion concentration in the surface phase of the grain of at least 5 times that of the inside phase of the grain. The total gelatin weight of the color photographic material is 7 g or less per $m^2$ of photographic material. In the color development step, the color photographic material is processed for a time of from 5 seconds to 30 seconds while striking the surface of the light-sensitive layer of the color photographic material with jet streams of a color development processing solution.

(2) A color image forming process of the foregoing process (1), wherein the surface phase of the grains of the silver halide emulsion are not more than 30% by volume of the whole grains, and the iron compound concentration in the surface phases is from $1\times10^{-5}$ to $1\times10^{-2}$ mol per mol of silver.

(3) A color image forming process of the foregoing process (1) or (2), wherein the silver halide grains of the silver halide emulsion have a silver bromide-containing localized phase having a silver bromide content of at least 20 mol % on the surface of the grain.

(4) A color image forming process of the foregoing process (1), (2) or (3), wherein the silver halide grains of the silver halide emulsion contain from $1\times10^{-8}$ to $1\times10^{-5}$ mol of an iridium ion per mol of silver In summary, it has been found that by color developing an exposed silver halide color photographic material having a high silver chloride content and containing an iron compound distributed as described above while applying thereto a color developer by jet stream stirring, the time dependence of the development progress, with a substantial shortening of the color development processing time, as described above, is astonishingly lowered and the occurrence of uneven density can be effectively restrained.

DETAILED DESCRIPTION OF THE INVENTION

Figure 1:
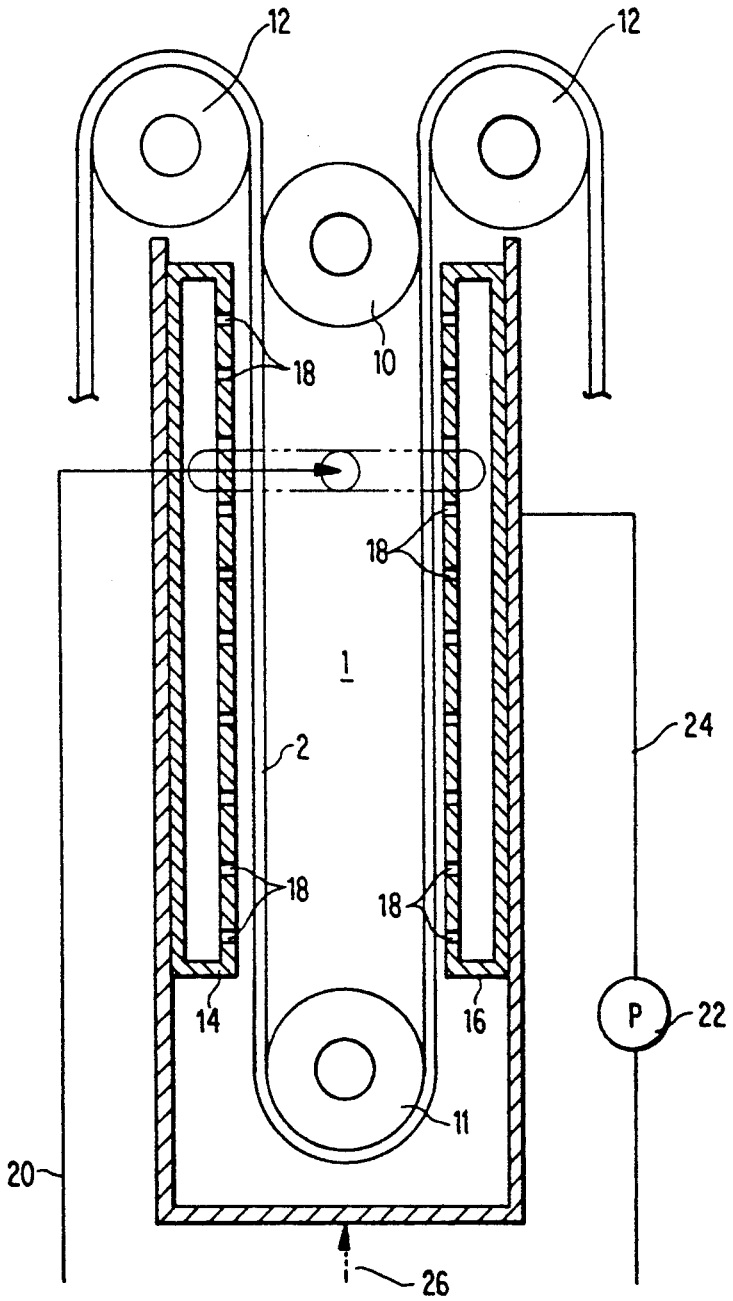
FIG. 1 is an enlarged sectional view showing the color development tank of an automatic processor for practicing the processing process of a color photographic material in this invention.

The silver halide of the silver halide emulsion for use in this invention is silver chlorobromide or silver chloride containing substantially no silver iodide and composed of at least 95 mol % silver chloride. The term "containing substantially no silver iodide" means that the silver halide contains less than 0.1 mol % silver iodide or contains no silver iodide. It is necessary that the content of silver chloride is at least 95 mol %, and the content thereof is more preferably at least 98 mol % based on the total silver halide content. In this invention, a silver halide emulsion composed of pure silver chloride which may contain an impurity ion such as an iron ion and an iridium ion is preferably used.

When the silver halide grains of the silver halide emulsion for use in this invention contain silver bromide, it is preferable that high silver bromide-containing localized phases having a silver bromide content of at least 20 mol % are formed on the surfaces of the silver halide grains.

Practical methods of forming the high silver bromide-containing localized phases are as follows.

In one method, after forming pure silver chloride grains, an aqueous solution of a silver ion and an aqueous solution of a bromide ion or a mixture of a bromide ion and a chloride ion are simultaneously supplied into the reaction vessel containing the pure silver chloride grains to form the silver bromide-containing localized phases on the surfaces of the foregoing pure silver chloride grains. In another method, after forming pure silver chloride grains, an aqueous solution of a bromide ion is supplied thereto or a high silver bromide-containing emulsion (including a pure silver bromide emulsion) composed of silver bromide grains having a smaller grain size than that of the foregoing silver chloride grains is added thereto. A so-called halogen conversion reaction is caused, forming the silver bromide-containing localized phases on the surfaces of the pure silver chloride grains. These methods are disclosed in U.S. Pat. No. 4,865,962 in detail.

In the foregoing methods, the formation of the silver bromide-containing localized phases may be carried out in the same reaction vessel successively after the formation of pure silver chloride grains or may be carried out after washing with water and desalting the pure silver chloride grains formed.

In this invention, to incorporate an iron ion in the silver halide grains of the silver halide emulsion, a method of forming the silver halide grains in the presence of a water-soluble iron compound is suitable. The iron compound is a compound containing a divalent or trivalent iron ion and it is preferable that the iron compound has a water solubility in the concentration range used in this invention. A method of using an iron complex salt which can be easily incorporated in the inside of silver halide grains is particularly preferable. Practical examples of these compounds are illustrated below, but iron compounds which can be used in this invention are not limited to them.

The iron compounds include ferrous arsenate, ferrous bromide, ferrous carbonate, ferrous chloride, ferrous citrate, ferrous fluoride, ferrous formate, ferrous gluconate, ferrous hydroxide, ferrous iodide, ferrous lactate, ferrous oxalate, ferrous phosphate, ferrous succinate, ferrous sulfate, ferrous thiocyanate, ferrous nitrate, ammonium ferrous nitrate, basic ferric acetate, ferric albumate, ammonium ferric acetate, ferric bromide, ferric chloride, ferric chromate, ferric citrate, ferric fluoride, ferric formate, ferric glycerophosphate, ferric hydroxide, ferric acidic phosphate, ferric nitrate, ferric phosphate, ferric pyrophosphate, sodium ferric pyrophosphate, ferric thiocyanate, ferric sulfate, ammonium ferric sulfate, guanidium ferric sulfate, ammonium ferric citrate, hexacyano iron(II) acid potassium, pentacyanoammine iron(II) potassium, ethylenedinitrilotetraacetic acid iron(III) sodium, hexacyano iron(III) acid potassium, tris(bipyridyl) chloride iron(III), and pentacyanonitrosyl iron(III) potassium.

Among these compounds, hexacyano iron(II) acid salts, hexacyano iron(III) acid salts, ferrous thiocyanates, and ferric thiocyanates show particularly remarkable effects.

The aforesaid iron compound can be incorporated in silver halide grains by placing the iron compound in a solution of a dispersion medium gelatin or other polymer having a protective colloid property), an aqueous halide solution, an aqueous silver salt solution, or an other aqueous solution during the formation of silver halide grains.

The content of the iron compound is from $1\times10^{-6}$ to $1\times10^{-3}$ mol and preferably from $1\times10^{-5}$ to $5\times10^{-4}$ mol per mol of silver of the silver halide grains. If the content of the iron compound is below than the foregoing range, the effect of improving the development progress is scarcely obtained and also if the content thereof is above the foregoing range, a clear disturbance occurs on the surface form of the silver halide grains and the sensitivity is undesirably reduced.

It is necessary that the iron compound being used in this invention is unevenly distributed in the surface phases at a higher iron ion concentration of at least 5 times, preferably at least 10 times, that in the inside phases of the silver halide grains. However, it is effective that at least 90% of the total amount of iron exists in the surface phases constituting not more than 30% of the volume of silver halide grains and the iron compound concentration in the surface phases is from $1\times10^{-5}$ to $1\times10^{-2}$ per mol of silver in the surface phases. It is more preferable that at least 95% of the total iron amount exists in the surface phases constituting not more than 20% of the volume of the silver halide grains.

The silver halide grains contained in the emulsion of the present invention have a laminated layer type structure composed of two or more layers each having a different iron ion content. Of the layers constituting the laminated layer type structure, the layer closest to the surface of the grain is defined as a surface phase of the grain, and the other portion thereof is defined as an inside phase of the grain. The inside phase of the grain may be composed of one or more layers.

The term "iron ion concentration of at least 5 times" means that an iron ion content in the surface phase of the grain is at least 5 times an average iron ion content in the inside phase thereof.

Also, the present invention includes embodiments in which all the iron ions of from $1\times10^{-6}$ to $1\times10^{-3}$ per mol of silver in the silver halide grains exist in the surface phases of the silver halide grains (that is, the iron ions do not exist in the inside phases of the silver halide grains).

The reason that the above uneven distribution of iron ions gives the effect of the present invention has not yet been clarified. As disclosed in the prior art described above, it is known that an iron ion has a function of increasing the sensitivity of a photographic light-sensitive material by increasing the latent image forming efficiency at image exposure. Accordingly, it is believed that the effect of improving the processing dependence in this invention is obtained because the preferred latent images being quickly developed are formed by the action of an iron ion in the domain near the surface of silver halide grains. However, whether or not a certain photographic action is obtained, in general, largely depends on the developing conditions for a photographic light-sensitive material. In sufficiently long development processing, the effect of the present invention can not be obtained.

To incorporate an iridium ion in the silver halide grains of the silver halide emulsion, a water-soluble iridium compound is preferably used. Practical examples of the iridium compound are a hexahalogenoiridium (III) potassium salt, a hexahalogenoiridium(III) ammonium salt, a hexahalogenoiridium(IV) potassium salt, a hexahalogenoiridium(IV) ammonium salt, iridium(III) chloride, iridium(IV) chloride, iridium(III) bromide, and iridium(IV) bromide.

The amount of the iridium salt is preferably from $1\times10^{-8}$ to $1\times10^{-5}$ mol, and more preferably from $5\times10^{-8}$ to $5\times10^{-6}$ mol, per mol of silver halide. There is no particular restriction on the position of silver halide grains containing the iridium ion, but the particularly preferred position is in the surface phases and/or the silver bromide-containing localized phases.

The color development time in this invention is from 5 to 30 seconds, and preferably from 5 to 20 seconds. The term "color development time" in this invention is the time from the entrance of a photographic light-sensitive material in a color developer to the entrance thereof in the subsequence bath (including the transporting time). The color developing temperature is preferably from 30° C. to 50° C., and the amount of the replenisher for the color developer is preferably from 20 ml to 600 ml per square meter of the photographic light-sensitive material being processed.

Furthermore, it is preferable that the color developer contains substantially no sulfite ion and/or hydroxylamine.

The jet stream of the color developer or other processing solution in the present invention can be generated by sucking the processing solution in the processing bath by a pump and jetting the solution onto the surface of the emulsion layer from nozzles or slits facing the surface of the emulsion layer of the photographic light-sensitive material being processed. More practically, the method of jetting a solution pushed by a pump through a slit or nozzle disposed facing the surface of the emulsion layer of a photographic light-sensitive material described in the example of JP-A-62-183460 can be used.

FIG. 1 shows an embodiment of the color developing bath 1 of an automatic developing machine which is used for processing a color photographic light-sensitive material according to this invention.

In the automatic processor, a photographic light-sensitive paper 2 is successively sent through the color developing tank 1, a bleach-fix tank (not shown), a wash tank (not shown) and/or a stabilization tank (not shown), and then dried in a drying section (not shown).

Each processing tank was filled with a processing solution. The photographic paper 2 is transported by rollers 10 and 11, and then sent to the subsequent processing tank by a roller 12.

In the color developing tank 1 are disposed chambers 14 and 16 for generating a high-speed liquid stream onto the emulsion layer of a photographic light-sensitive paper 2 traveling by the rollers 10 and 11. As shown in FIG. 1, these chambers 14 and 16 are box-form chambers made of a thin plate. Multiple slits 18 for supplying jet streams of color developer are formed facing the emulsion layer of the traveling photographic paper 2. These slits 18 are slender openings extending in a right-angled direction to the traveling direction of the photographic paper 2, that is, to the width direction of the photographic paper. But several openings, each having a small diameter, may be formed in place of the foregoing slits or nozzles for directing the jet stream of the processing solution.

These chambers 14 and 16 are connected to a pump 22 through a supplying pipe 20, and the processing solution is sent to the chambers by the pump 22. The pump 22 is connected to an upper part of the color developer tank 1 by a pipe 24 and sucks the processing solution in the color developer tank 1. Also, a part of the liquid supplying pipe 20 can be connected to a lower portion of the color developer tank 1 through liquid supplying pipe 26. When the color developer tank 1 is a large-sized tank, if necessary, the processing solution can be supplied to the lower portion of the processing tank from the pump 22. The liquid supplying pipe 26 has the function of circulating the processing solution in the processing tank at a low speed.

Also, a fresh processing solution (replenisher) is supplied to each processing tank, and the overflow processing solution is discharged or reused.

When the automatic processor is operated and the rollers 10, 11, and 12 are rotated, a photographic paper 2 is successively sent to each processing tank. If necessary, a leader, etc., is attached to the top of a photographic paper being processed and the photographic paper may be guided to each roller by using the leader, etc.

The pump 22 sends the processing solution into the color developer tank 1 through pipes 24 and 26. The processing solution supplied into the color developer tank 1 though the pipe 26 is circulated in the color developer tank 1 at a relatively low speed and is returned to he pump 22 from the upper portion of the tank 1.

The rate of the jet stream striking the emulsion layer is as high as possible in the range which does not hinder the transport of the photographic light-sensitive material. Practically, the rate is preferably in the range of from 0.3 to 3 meters per second.

The streaming amount of the processing solution at the jet stream is at least 0.5 liter per minute for the photographic light-sensitive material having a width of 30 cm, but is preferably at least 1 liter/min., and more preferably at least 3 liters/min. The upper limit is preferably 10 liters/min. Though circumstances may differ according to the form of the processing apparatus, an excessive streaming amount is undesirable from the view points of the transporting property of the photographic light-sensitive material, scattering of the processing solution, and the stability of the processing solution over the passage of time.

The objects of this invention can be attained by carrying out stirring by jet stream of the processing solution in a color development bath only, but it is preferred to use such jet stream in an other process bath. In particular, it is preferred to use the jet stream in a bleach-fix (or blix) bath. Further it is more preferred to use the jet stream in at least one wash bath or a stabilization bath in addition to the blix bath.

In the case of, for example, a color development bath, the effect of the jet stream in this invention is believed to promote the permeation of the color developer, etc., into the light-sensitive layers of a photographic light-sensitive material. Furthermore in other processing bathes, it is considered that in addition to the permeation of the components of the processing solution into the light-sensitive layers as in the foregoing case, the step of washing out the components in the pre-bath remaining in the light-sensitive layers is accelerated by the jet stream of the processing solution.

In the present invention, it is preferable that the photographic processing is carried out using an automatic processor. The preferred embodiment of the automatic processor in this case requires that (1) each processing bath has a mechanism of liquid circulation such that the processing solution in the tank is sprayed onto the surface of the light-sensitive layer of a photographic light-sensitive material in an amount of at least 1 liter/min., preferably at least 3 liters/min., (2) the automatic processor has a structure so that the ratio of the area of the surface of the color developer in the color development bath which is in contact with air to the total volume of the development bath is not more than 0.1 $cm^2$/ml, and preferably rot more than 0.05 $cm^2$/ml, (3) the automatic processor has a structure so that in the path from the entrance of a photographic light-sensitive material in the color development bath and the blix bath to the entrance of the subsequent bath through the air, the ratio of the time of the light-sensitive material in the air (A) to the time in the liquid of each bath (B), i.e., A/B is not more than 1.0, and preferably not more than 0.7, (4) several rollers for wiping off a liquid attached to the surface of the photographic light-sensitive material are disposed between the final rinse bath and the drying section, and (5) the automatic processor has a drying section having an air circulating mechanism which blows a drying blast against the light-sensitive layer surface of a photographic light-sensitive material through a porous plate or slits at a wind speed of at least 1 meter/sec., and preferably at least 3 meters/sec.

The color photographic light-sensitive material for use in this invention can be prepared by coating at least one blue-sensitive silver halide emulsion layer, at least one green-sensitive silver halide emulsion layer, and at least one red-sensitive silver halide emulsion layer on a support. In an ordinary color photographic paper, the silver halide emulsion layers are formed on a support in the above-described order, but other disposition orders of the emulsion layers may be employed. Also, an infrared-sensitive silver halide emulsion layer can be used in place of at least one of the foregoing emulsion layers.

By incorporating in each of these light-sensitive emulsion layers a silver halide emulsion having a sensitivity in each wavelength region and a so-called color coupler forming a dye in the relation of a complementary color to the sensitive light, that is, forming a yellow dye to blue light, a magenta dye to green light, and a cyan dye to red light, a color reproduction by a subtractive color process can be carried out. However, with regard to the light-sensitive layer and the colored hue of a color coupler, other constructions than the one above may be employed.

As the silver halide emulsion being used in this invention, an emulsion composed of silver chlorobromide or silver chloride containing substantially no silver iodide can be preferably used as described hereinbefore. The halogen composition of the silver halide emulsion may be different or the same among the silver halide grains. But by using a silver halide emulsion having a same halogen composition among the silver halide grains, the property of each grain can be easily homogenized.

Also, as to the distribution of the halogen composition in the inside of the silver halide grains of the silver halide emulsion, (1) silver halide grains of a so-called uniform-type structure in which the halogen composition of each portion of each silver halide grain is same, (2) silver halide grains of a so-called laminated layer type structure core/shell type structure) in which the halogen composition differs between the core of the inside of each silver halide grain and the shell (one layer or more layers) surrounding the core, or (3) silver halide grains having the structure in which non-layers form portions of a different halogen composition in the inside or on the surface of each silver halide grain (when such portions are on the surface of each grain, it takes a structure so that the portions of a different composition are junctioned to the edges, corners, or the surface of the grain), can be properly selected. For obtaining a high sensitivity, the use of the latter two types is more advantageous than the use of the silver halide grains having a uniform-type structure. Also, the use of the latter two types is also preferable from the view point of pressure resistance.

When silver halide grains have the foregoing structure, the boundary portion between the portions which have a different halogen composition may be a clear boundary, an indistinct boundary forming mixed crystals because of the difference in halogen composition, or a boundary positively provided with a continuous structure change.

The mean grain size (the diameters of circles having the same area as the projected area of the silver halide grains are defined as the grain sizes and the number average is employed as the mean grain size) of the silver halide grains contained in the silver halide emulsion for use in this invention is preferably from 0.2 μm to 0.7 μm.

Also, the grain size distribution is preferably a so-called monodisperse having a coefficient of variation (the value of the standard deviation of the grain size distribution divided by the mean grain size) of not larger than 20%, and preferably not larger than 15%. In this case, for obtaining a wide latitude, it is preferred to use the foregoing two or more monodisperse emulsions each having a different grain size in the same layer as a blend thereof or to coat them in the form of a layered structure. When several kinds of silver halide grains, each having a different grain size, are used in a photographic light-sensitive material, even when the silver halide grains is in a same light-sensitive layer or in different light-sensitive layers, the ratio of the mean grain sizes of these silver halide grains is preferably from 0.63 to 1.6, and more preferably from 0.77 to 1.3.

The silver halide grains for use in this invention may have a regular crystal form such as cubic, tetradecahedral, or octahedral; an irregular crystal form such as spherical, tabular, etc.; or a composite of these crystal forms. A mixture cf various crystal forms can be used. In this invention, the content of silver halide grains having the foregoing regular crystal form is at least 50%, preferably at least 70%, and more preferably at least 90%.

Also, a silver halide emulsion containing tabular silver halide grains having an aspect ratio (circle-converted diameter/thickness) of at least 5, and preferably at least 8, in a content cf over 50% of the total silver halide grains, can be preferably used.

The silver halide emulsion for use in this invention can contain various polyvalent metal ion impurities other than the foregoing iron ion and iridium ion. Examples of these metal ion impurity are salts of cadmium, zinc, lead, copper, thallium etc., and salts or complex salts of metals belonging to group VIII of the periodic table, such as luthenium, rhodium, palladium, osmium, platinum, etc. In particular, the compounds of the metals belonging to Group VIII are preferably used in this invention. The addition amount of the aforesaid compound is in a wide range according to the specific purpose, but is preferably from $1\times10^{-9}$ to $1\times10^{-3}$ mol.

The silver halide emulsion for use in this invention is usually chemically sensitized.

The chemical sensitization can be carried out by a sulfur sensitization such as the addition of an unstable sulfur compound, a noble metal sensitization such as a gold sensitization, and a reduction sensitization, either solely or as a combination thereof. As the compound for the chemical sensitization, the compounds described in JP-A-62-215272 can be preferably used.

Also, the silver halide emulsion for use in this invention is usually subjected to a spectral sensitization.

The spectral sensitization is applied to impart a spectral sensitivity in a desired light wavelength region to the silver halide emulsion in each layer of the color photographic material in this invention. It is preferred that the spectral sensitization is carried out by adding a spectral sensitizing dye, i.e., a dye absorbing light of a wavelength region corresponding to the desired spectral sensitivity. Examples of the spectral sensitizing dye which is used in this invention are described in F. M. Harmer, *Heterocyclic Compounds-Cyanine Dyes and Related Compounds,* published by John Wiley & Sons (New York, London), 1964. Examples of the preferred compounds and spectral sensitizing methods are described in JP-A-62-215272.

The silver halide emulsion for use in this invention can also contain various compounds or the precursors thereof for preventing the occurrence of fog during production, storage, or photographic processing of the color photographic material or for stabilizing the photographic performance thereof. Practical examples of these preferred compounds are described in JP-A-62-215272.

The silver halide emulsion for use in this invention may be a so-called surface latent image-type emulsion forming latent images mainly on the surface of the silver halide grains thereof or a so-called internal latent image type emulsion forming latent images mainly in the inside of the silver halide grains thereof.

When the process of the present invention is applied to a color photographic light-sensitive material, a yellow coupler, a magenta coupler, and a cyan coupler which are colored into yellow, magenta, and cyan, respectively, by causing coupling with the oxidation product of an aromatic primary amino color developing agent are usually used for the color photographic material.

The cyan couplers, magenta couplers, and yellow couplers which are preferably used in this invention are those shown by following Formulae (C-I), (C-II), (M-I), (M-II), and (Y), respectively;

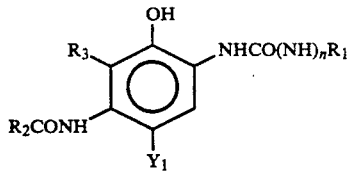

(C-I)

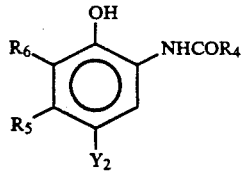

(C-II)

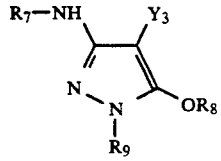

(M-I)

-continued

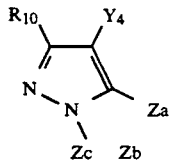

(M-II)

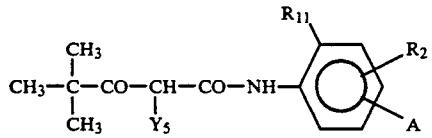

(Y)

In formulae (C-I) and (C-II), $R_1$, $R_2$, and $R_4$ each represents a substituted or unsubstituted aliphatic group, a substituted or unsubstituted aromatic group, or a substituted or unsubstituted heterocyclic group; $R_3$, $R_5$ and $R_6$ each represents a hydrogen atom, a halogen atom, an aliphatic group, an aromatic group, or an acylamino group. The term $R_3$ may represent a nonmetallic atomic group forming with $R_2$ a nitrogen-containing 5-membered ring or 6-membered ring; $Y_1$ and $Y_2$ each represents a hydrogen atom or a group capable of releasing at the coupling reaction with the oxidation product of a color developing agent; and n represents 0 or 1.

In formula (C-II), $R_5$ is preferably an aliphatic group and examples thereof include methyl, ethyl, propyl, butyl, pentadecyl, tert-butyl, cyclohexyl, cyclohexylmethyl, phenylthiomethyl, dodecyloxyphenylthiomethyl, butaneamidomethyl, and methoxymethyl groups.

In the cyan couplers shown by aforesaid formula (C-I) or (C-II), preferred examples thereof are as follows.

In formula (C-I), $R_1$ is preferably an aryl group or a heterocyclic group and is more preferably an aryl group substituted with a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group.

In formula (C-I), when a ring is not formed by $R_3$ and $R_2$, $R_2$ is preferably a substituted or unsubstituted alkyl group or a substituted or unsubstituted aryl group, and particularly preferably an alkyl group substituted by a substituted aryloxy group, and $R_3$ is preferably a hydrogen atom.

In formula (C-II), $R_4$ is preferably a substituted or unsubstituted alkyl group or a substituted or unsubstituted aryl group, and particularly preferably an alkyl group substituted by a substituted aryloxy group.

In formula (C-II), $R_5$ is preferably an alkyl group having from 2 to 15 carbon atoms and a methyl group having a substituent having at least 1 carbon atom. Preferred examples of the substituent are an arylthio group, an alkylthio group, an acylamino group, an aryloxy group, and an alkyloxy group.

In formula (C-II), $R_5$ is more preferably an alkyl group having from 2 to 15 carbon atoms, and particularly preferably an alkyl group having from 2 to 4 carbon atoms.

In formula (C-II), $R_6$ is preferably a hydrogen atom or a halogen atom, and particularly preferably chlorine or fluorine atom.

In formulae (C-I) and (C-II), $Y_1$ and $Y_2$ each is preferably a hydrogen atom, a halogen atom, an alkoxy group, an aryloxy group, an acyloxy group, or a sulfonamido group.

In formula (M-I), $R_7$ and $R_9$ each represents an aryl group; $R_8$ represents a hydrogen atom, an aliphatic or aromatic acyl group, or an aliphatic or aromatic sulfonyl group; and $Y_3$ represents a hydrogen group or another releasable group.

The aryl group (preferably a phenyl group) shown by $R_7$ and $R_9$ may have a substituent such as those described above as the substituents for $R_1$. When the aryl group has two or more substituents, they may be the same or different. $R_8$ is preferably a hydrogen atom, an aliphatic acyl group or an aliphatic sulfonyl group and is particularly preferably a hydrogen atom. Also, $Y_3$ is preferably a group capable of releasing a sulfur atom, an oxygen atom or a nitrogen atom and the sulfur atom releasing types described in U.S. Pat. No. 4,351,897 and WO 88/04795 are particularly preferred.

In formula (M-II), $R_{10}$ represents a hydrogen atom or a substituent; $Y_4$ represents a hydrogen atom or a releasable group and is particularly preferably a halogen atom or an arylthio group; and Za, Zb, and Zc each represents methine, a substituted methine, =N—, or —NH—; one of the Za-Zb bond and the Zb-Zc bond is a double bond and the other is a single bond. When the Zb-Zc bond is a carbon-carbon double bond, it may be a double bond which is a part of an aromatic ring.

Specific non-limiting examples of the substituents of $R_{10}$ include an alkyl group (which may be a straight chain or branched alkyl group having preferably 1 to 32 carbon atoms, e.g., methyl, ethyl, tert-butyl, isopropyl), an aryl group (e.g., phenyl), an anilino group, an acylamino group (e.g., alkylcarbonylamino, arylcarbonylamino), a sulfonamido group (e.g., alkylsulfonylamino, arylsulfonylamino), an alkylthio group, an arylthio group, an alkenyl group (which may be a straight chain or branched alkenyl group having preferably 2 to 32 carbon atoms), a cycloalkyl group (having preferably 3 to 12, particularly preferably 5 to 7 carbon atoms), a halogen atom, a cycloalkenyl group (having preferably 3 to 12, particularly preferably 5 to 7 carbon atoms), an alkynyl group, a sulfonyl group (e.g., alkylsulfonyl, arylsulfonyl), a sulfinyl group (e.g., alkylsulfinyl, arylsulfinyl), a phosphonyl group (e.g., alkylphosphonyl, alkoxyphosphonyl, aryloxyphosphonyl, arylphosphonyl), an acyl group (e.g., alkylcarbonyl, arylcarbonyl), a carbamoyl group (e.g., alkylcarbamoyl, arylcarbamoyl), a sulfamoyl group (e.g , alkylsulfamoyl, arylsulfamoyl), a cyano group, an alkoxy group, an aryloxy group, a siloxy group (e.g., trimethylsiloxy, triethylsiloxy, dimethylbutylsiloxy), an acyloxy group (e.g., alkylcarbonyloxy, arylcarbonyloxy), a carbamoyloxy group (e.g., alkylcarbamoyloxy, arylcarbamoyloxy), an amino group, an alkylamino group, an imido group (e.g., succinic acid imido, 3-heptadecylsuccinic acid imido, phthalimide, glutarimide), a ureido group (e.g., alkylureido, arylureido), a sulfamoylamino group (e.g., alkylsulfamoylamino, arylsulfamoylamino), an alkoxycarbonylamino group, an aryloxycarbonylamino group, an alkoxycarbonyl group, an aryloxycarbonyl group, a heterocyclic group (preferably 5- to 7-membered, e.g., 2-furyl, 2-thienyl, 2-pyrimidinyl, 2-benzothiazolyl), a heterocyclic oxy group (preferably 5- to 7-membered, e.g., 3,4,5,6,-tetrahydropyranyl-2-oxy, 1-phenyltetrazol-5-oxy), a heterocyclic thio group (preferably 5- to 7-membered, e.g., 2-pyridylthio, 2-benzothiazolylthio, 2,4-diphenoxy-1,3,5-triazol-6-thio), a spiro compound residual group (e.g., spio(3,3)heptan- 1-yl), and an organic hydrocarbon compound residual group (e.g., bicyclo(2,2,1)heptan-1-yl, tricyclo-(3.3,1,1$^{3/7}$)decan-1-yl, 7,7-dimethyl-bicyclo(2,2,1)-heptan-1-yl, etc.

The alkyl component or aryl component in the alkylthio group or arylthio group shown by $R_{10}$ can include the alkyl group or aryl group described for $R_{10}$.

The magenta coupler shown by formula (M-II) includes a dimer or higher polymer formed by $R_{10}$ or $Y_4$. When Za, Zb or Zc is a substituted methine, the coupler includes a dimer or polymer formed b). the substituted methine.

In a pyrazoloazole series couplers shown by formula (M-II), the imidazo[1,2-b]pyrazoles described in U.S. Pat. No. 4,500,630 are preferred from the view point of less yellow side absorption and the light fastness of the colored dye. The pyrazolo[1,5-b][1,2,4]triazole described in U.S. Pat. No. 4,530,654 is particularly preferred.

Furthermore, the pyrazolotriazole couplers wherein a branched alkyl group is directly bonded to the 2-, 3- or 6-position of the pyrazolotriazole ring as described in JP-A-61-65245, the pyrazoloazole couplers containing a sulfonamido group in the molecule as described in JP-A-61-65246, the pyrazoloazole couplers having an alkoxyphenylsulfonamide ballast group as described in JP-A-61-147254, and the pyrazolotriazole couplers having an alkoxy group or an aryloxy group at the 6-position as described in European Patent Application Nos. 226,849A and 294,785A, are preferably used.

In formula (Y), $R_{11}$ represents a halogen atom, an alkoxy group, a trifluoromethyl group, or an aryl group; $R_{12}$ represents a hydrogen atom, a halogen atom, or an alkoxy group; A represents —$NHCOR_{13}$, —$NHSO_2R_{13}$, —$SO_2NHR_{13}$, —$COOR_{13}$, or $$-SO_2\underset{\underset{R_{14}}{|}}{N}-R_{13}$$

(wherein $R_{13}$ and $R_{14}$ each represents an alkyl group, group, an aryl group, or an acyl group); and $Y_5$ represents a releasable group.

The groups shown by $R_{12}$, $R_{13}$, and $R_{14}$ may have a substituent such as those described above as a substituent for $R_1$. The releasable group shown by $Y_5$ releases an oxygen atom or a nitrogen atom and is particularly preferably a nitrogen atom releasing group.

Examples of the couplers represented by formulae (C-I), (C-II), (M-I), (M-II), and (Y) are illustrated below.

First, examples of the cyan couplers shown by Formulae (C-I) and (C-II) are shown below.

(C-1)

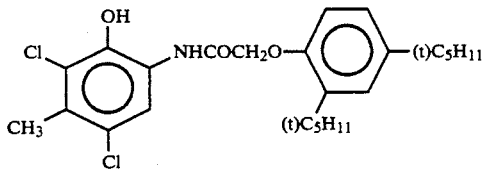

C-2)

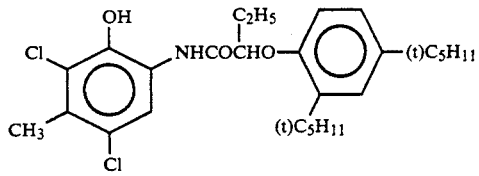

C-3)

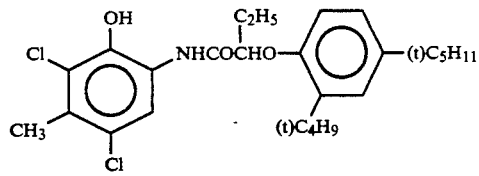

(C-4)

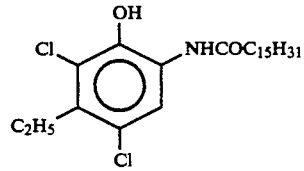

(C-5)

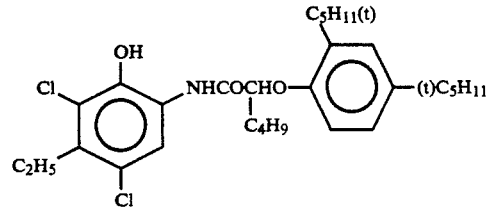

-continued
(C-6)
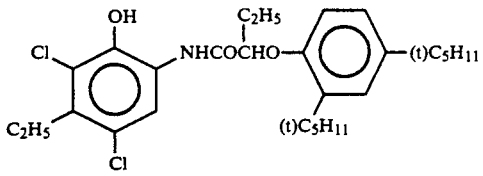
(C-7)
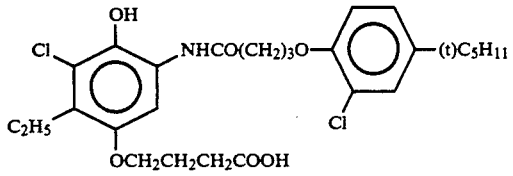
(C-8)
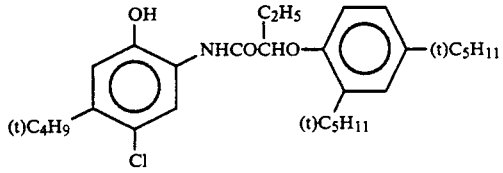
(C-9)
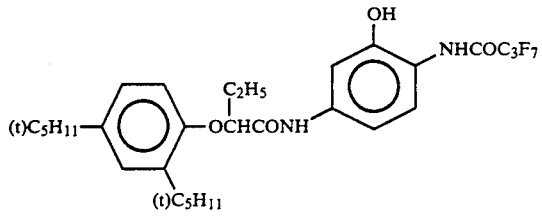
(C-10)
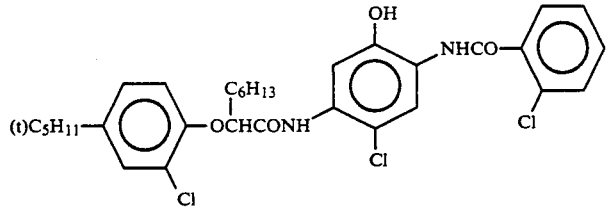
(C-11)
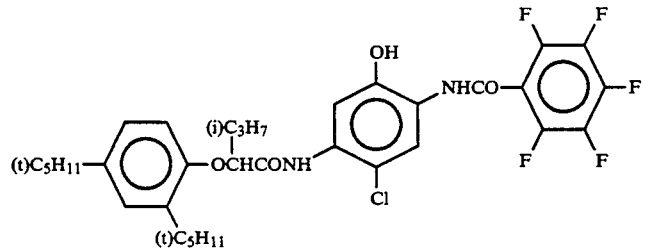
(C-12)
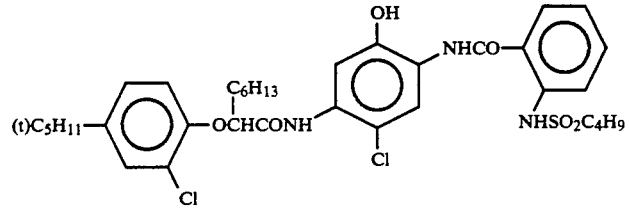

-continued
(C-13)
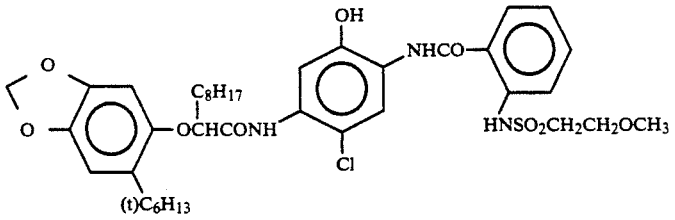
(C-14)
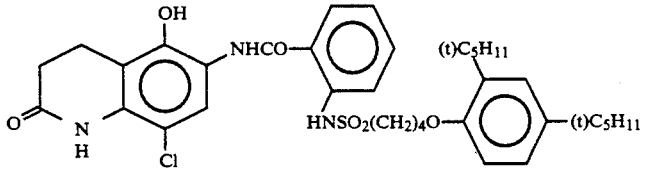
(C-15)
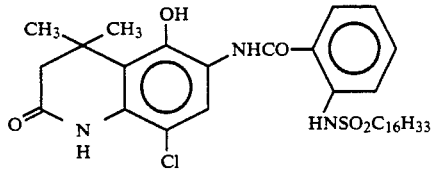
(C-16)
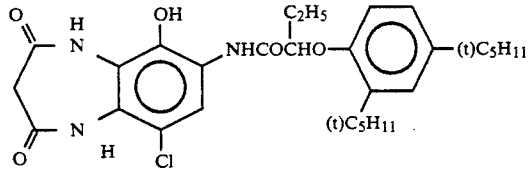
(C-17)
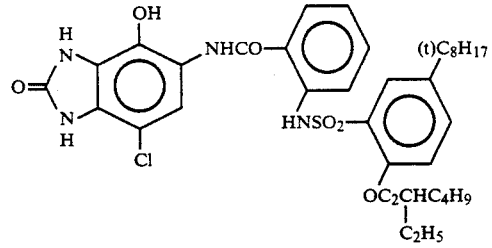
(C-18)
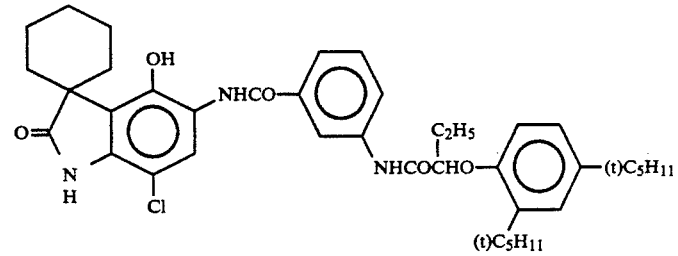
(C-19)
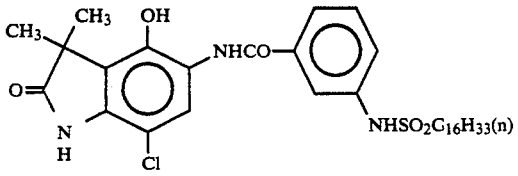

-continued
(C-20)
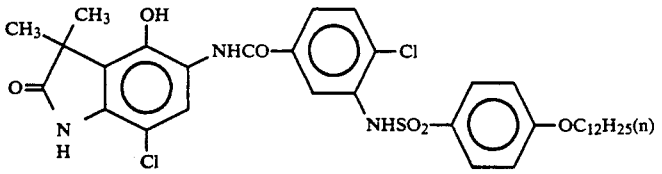
(C-21)
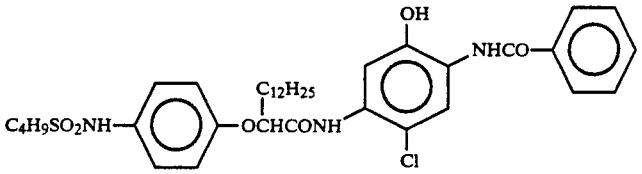
(C-22)
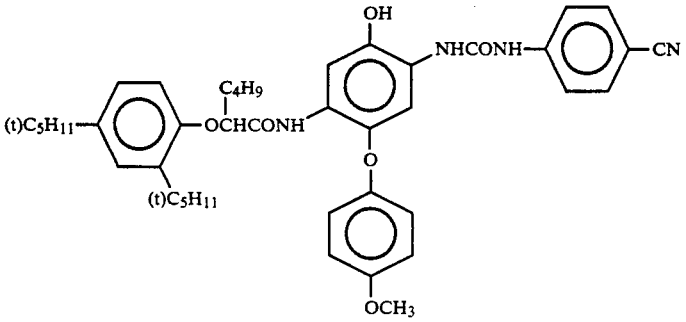
Then, specific examples of the magenta couplers shown by formulae (M-I) and (M-II) are shown below.
(M-1)
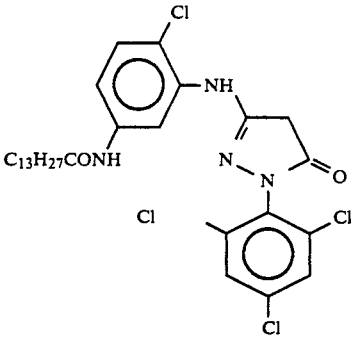
(M-2)
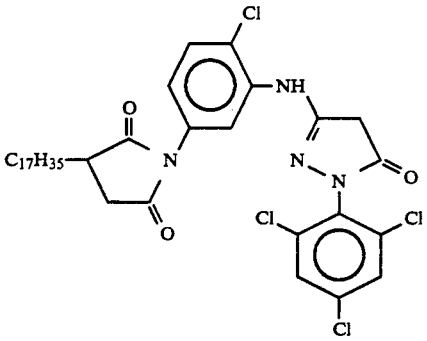

-continued
(M-3)
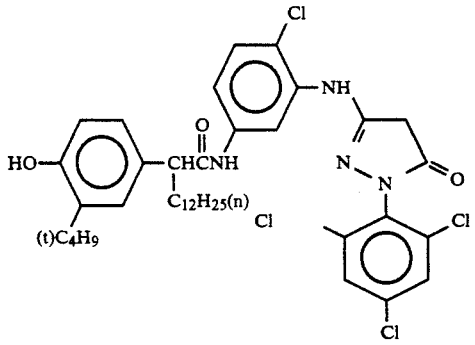
(M-4)
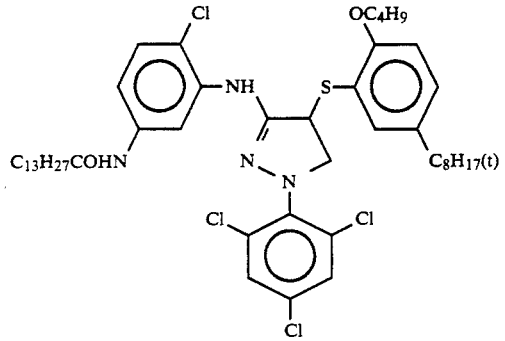
(M-5)
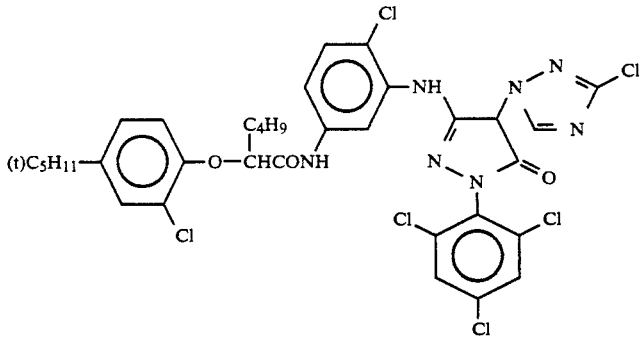
(M-6)
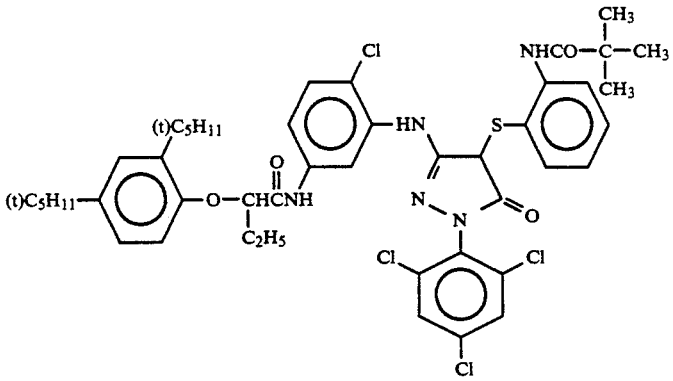

-continued
(M-7)
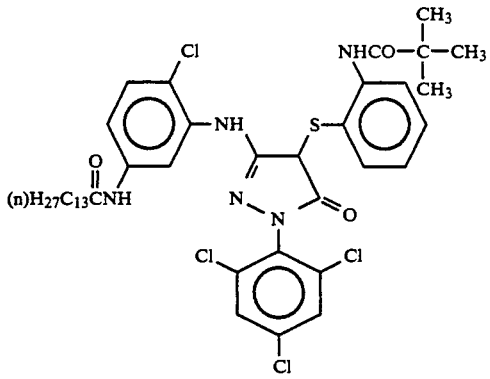
(M-8)
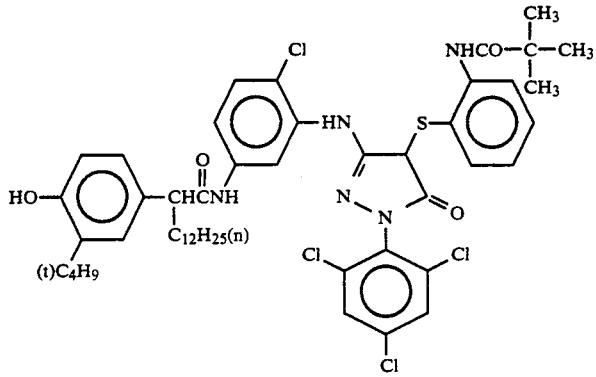
(M-9)
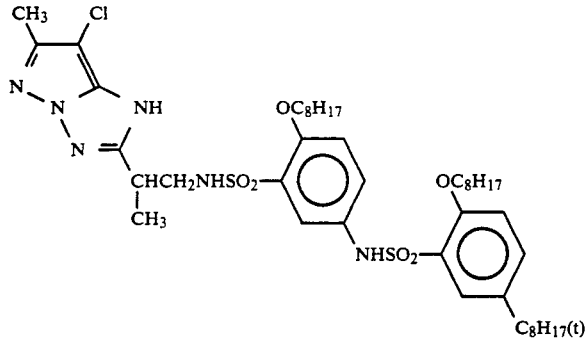
(M-10)
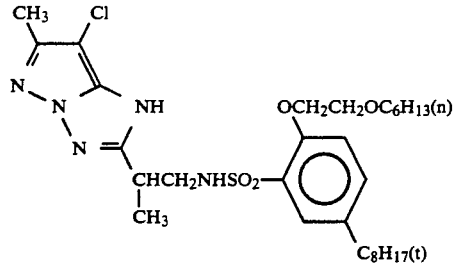
(M-11)
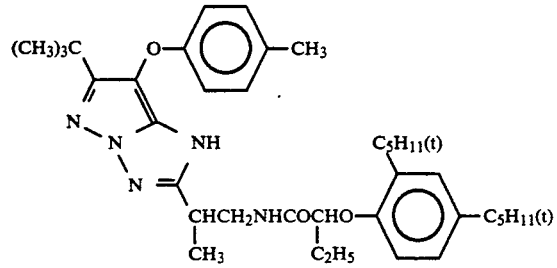

-continued
(M-12)
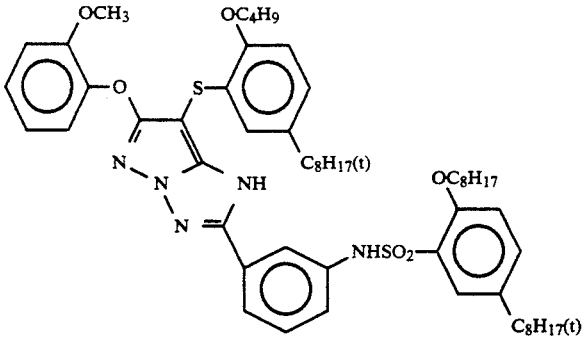
(M-13)
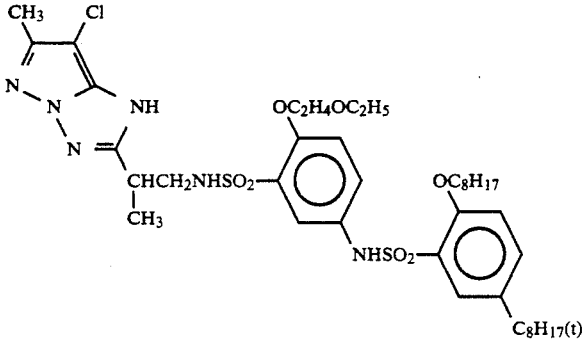
(M-14)
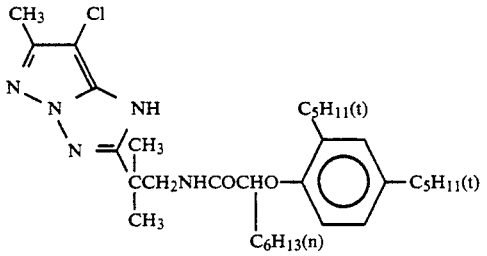
(M-15)
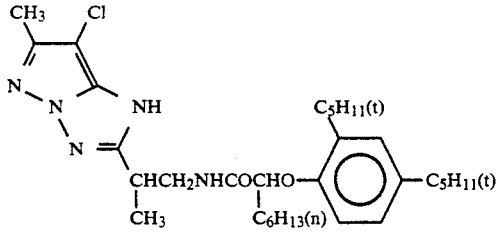
(M-16)
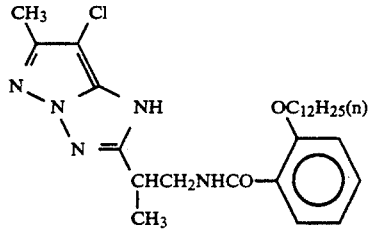
(M-17)
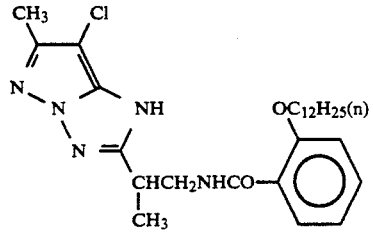

-continued
(M-18)
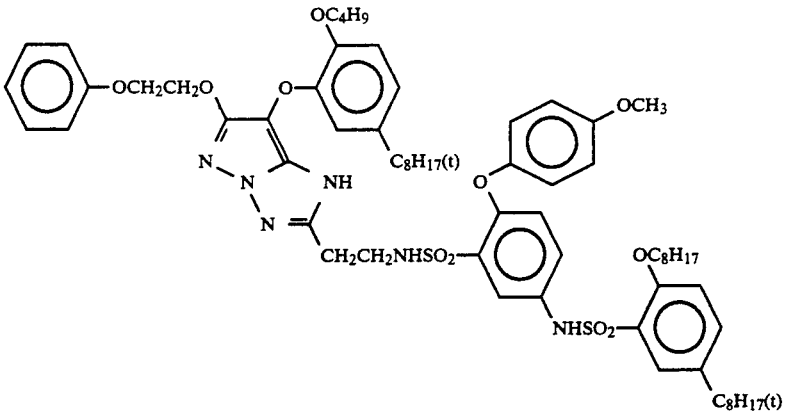
(M-19)
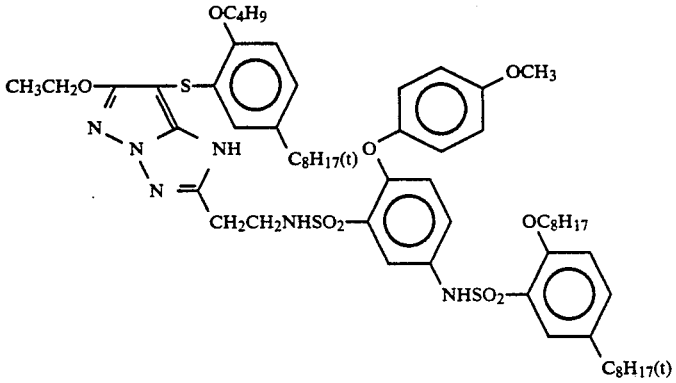
(M-20)
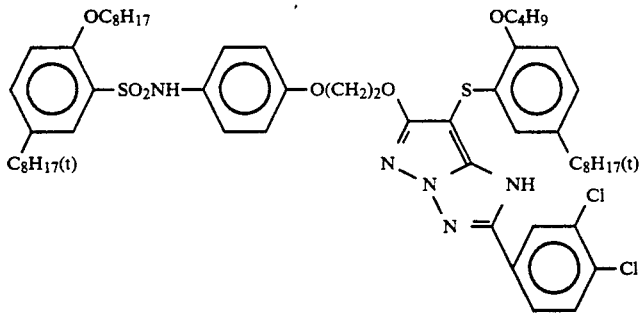
(M-21)
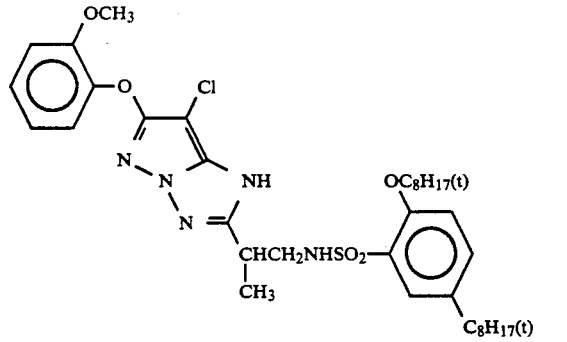
(M-22)
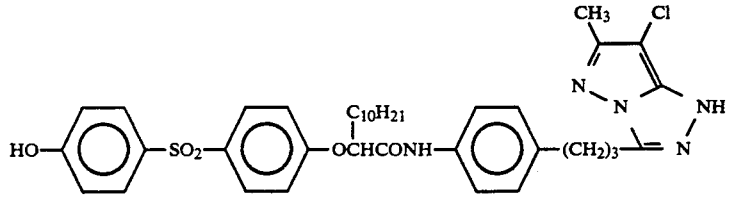

-continued
(M-23)
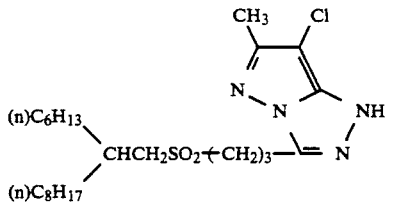
(M-24)
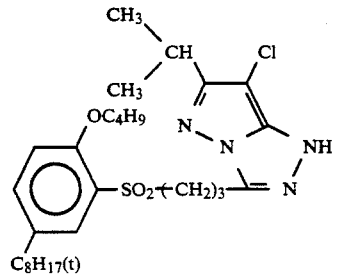
(M-25)
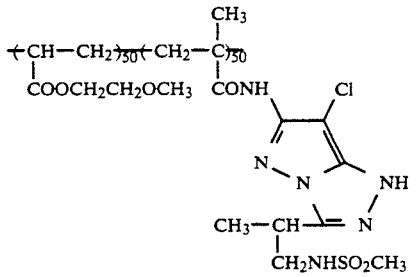
(M-26)
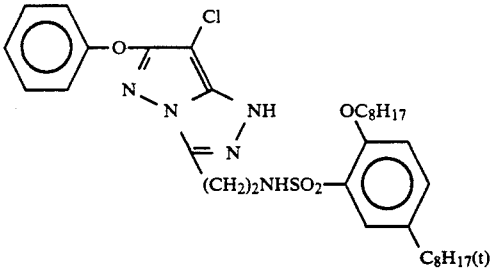
(M-27)
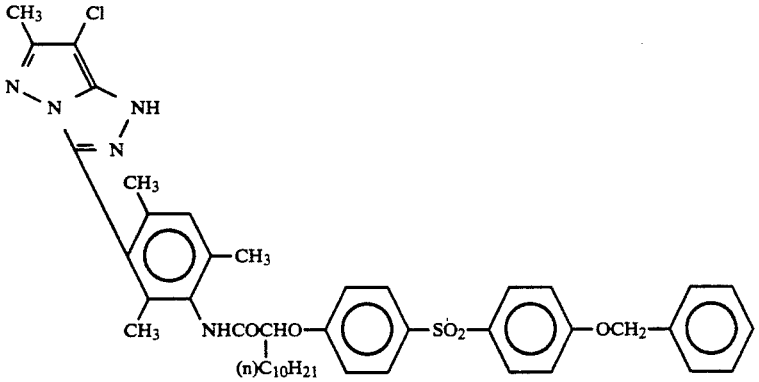

-continued
(M-28)
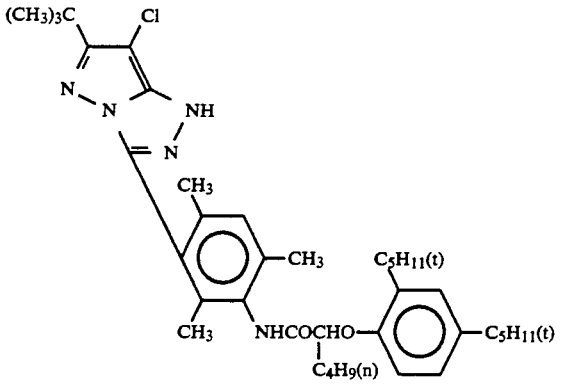
(M-29)
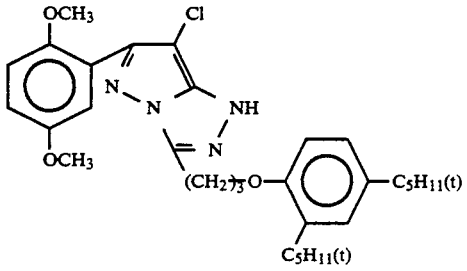
(M-30)
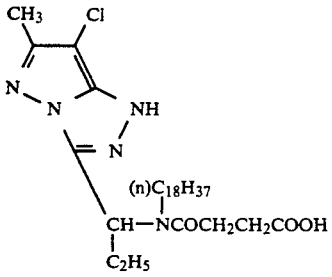
Then, specific examples of the cyan coupler shown by formula (Y) are shown below.
(Y-1)
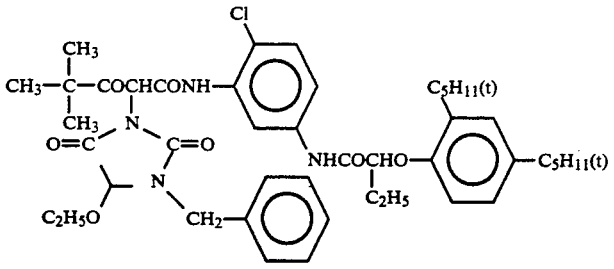
(Y-2)
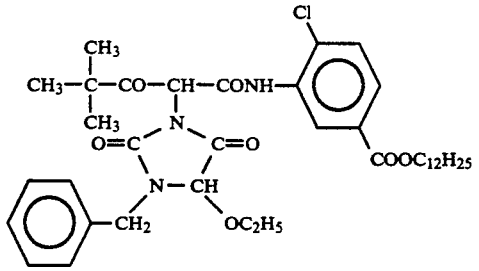

-continued
(Y-3)
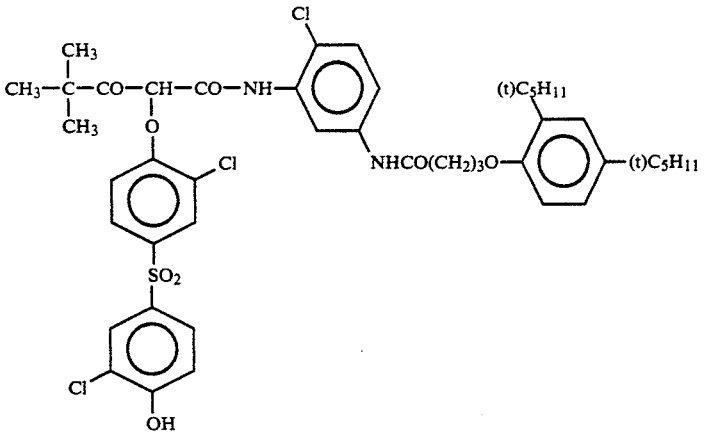
(Y-4)
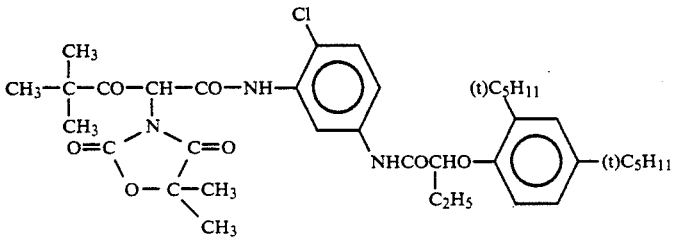
(Y-5)
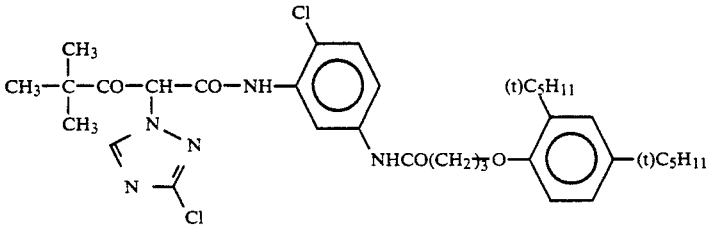
(Y-6)
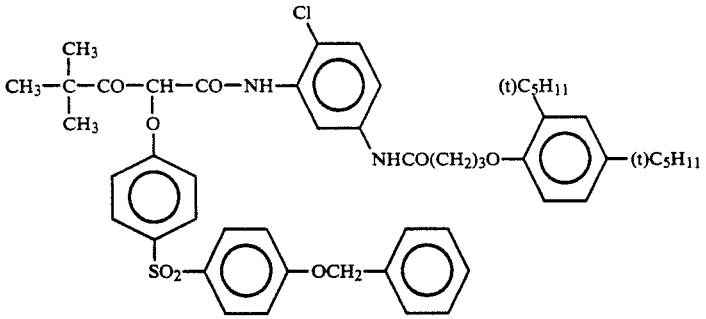
(Y-7)
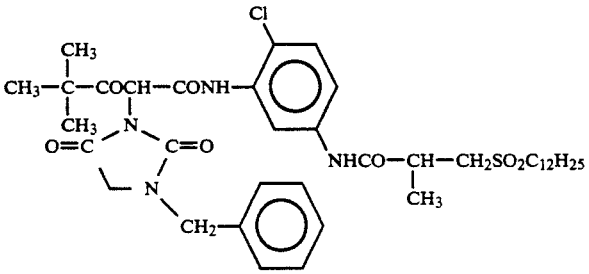

-continued (Y-8)

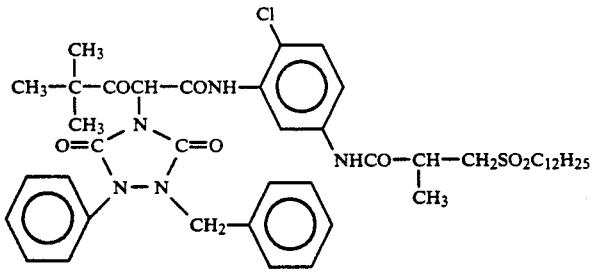

(Y-9)

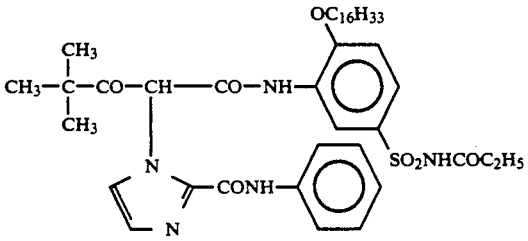

Each of the couplers shown by foregoing formulae (C-I) to (Y) is incorporated in a silver halide emulsion layer of the light-sensitive layer in an amount of from 0.1 to 1.0 mol, and preferably from 0.1 to 0.5 mol, per mol of silver halide.

As a dispersion medium for the aforesaid couplers, a high-boiling organic solvent and/or a water-insoluble high molecular compound having a dielectric constant (25° C.) of from 2 to 20 and a refraction index (25° C.) of from 1.5 to 1.7 is preferably used.

Preferred examples of the high-boiling organic solvent are the high-boiling organic solvents shown by following formulae (A) to (E).

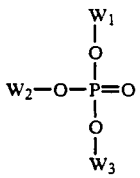

(A)

$W_1-COO-W_2$ (B)

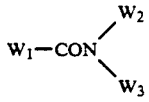

(C)

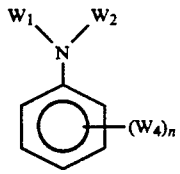

(D)

$W_1-O-W_2$ (E)

wherein $W_1$, $W_2$, and $W_3$ each represents a substituted or unsubstituted alkyl group, a substituted or unsubstituted cycloalkyl group, a substituted or unsubstituted alkenyl group, a substituted or unsubstituted aryl group, or a substituted or unsubstituted heterocyclic group; $W_4$ represents $W_1$, $OW_1$, or $S-W_1$; and n represents an integer of from 1 to 5. When n is 2 or more, $W_4$s may be the same or different and also in formula (E), $W_1$ and $W_2$ may form a condensed ring.

Other high-boiling organic solvents in addition to those shown by formulae (A) to (E), which are compounds having a melting point of not higher than 100° C. and a boiling point of at least 140° C., are immiscible with water, and are good solvents for a coupler, can be also used in this invention. The melting point of the high-boiling organic solvents which can be used in this invention is preferably not higher than 80° C. and the boiling point of the high-boiling organic solvents is preferably at least 160° C., and more preferably at least 170° C.

Details of these high-boiling organic solvents are described in JP-A-62-215272.

Also, the aforesaid coupler can be dispersed by emulsification in an aqueous solution of a hydrophilic colloid by impregnating a loadable latex polymer (described, e.g., in U.S. Pat. No. 4,203,716) with the coupler in the presence or absence of the foregoing high-boiling organic solvent or by dissolving the coupler in a water-insoluble and organic solvent-soluble polymer.

As that polymer, the homopolymer or copolymer described in WO 88/00723, pages 12 to 30 is used. An acrylamide series polymer is preferred from the view point of color image stability, etc.

The photographic material for use in this invention can further contain various fading inhibitors. As organic fading inhibitors for cyan, magenta and/or yellow color images, there are hydroquinones, 6-hydroxychromans, 5-hydroxycoumarans, spirochromans, p-alkoxyphenols, hindered phenols such as bisphenols, etc., gallic acid derivatives, methylenedioxybenzenes, aminophenols, hindered amines, and the ether or ester derivatives obtained by silylating or alkylating the phenolic hydroxy groups of the aforesaid compounds.

Also, metal complex salts such as (bissalicylaldoxymate) nickel complex and (bis-N,N-dialkyldithiocarbamate) nickel complex can be used.

Examples of the organic fading inhibitor include hydroquinones described in U.S. Pat. Nos. 2,360,290, 2,418,613, 2,700,453, 2,701,197, 2,728,659, 2,732,300, 2,735,765, 3,982,944, 4,430,425, 2,710,801, and 2,816,028 and British Patent 1,363,921; the 6-hydroxychromans, the 5-hydroxycoumarans and the spirochromans described in U.S. Pat. Nos. 3,432,300, 3,573,050, 3,574,627, 3,698,909, 3,764,337, and JP-A-52-152225; the spiroindanes described in U.S. Pat. No. 4,360,589; the p-alkoxyphenols described in U.S. Pat. No. 2,735,765, British Patent 2,066,975, JP-A-59-10539, and JP-B-57-19765; the hindered phenols described in U.S. Pat. Nos. 3,700,455 and 4,228,235, JP-A-52-72224, and JP-B-52-6623; the methylenedioxybenzenes and aminophenols described in U.S. Pat. Nos.3,457,079 and 4,332,886, and JP-B-56-21144; the hindered amines described in U.S. Pat. Nos. 3,336,135 and 4,268,593, British Patents 1,326,889, 1,354,313, and 1,410,846, JP-B-51-1420, JP-A-58-114036, JP-A-59-53846, and JP-A-59-78344; and the metal complexes described in U.S. Pat. Nos.4,050,938 and 4,241,155 and British Patent 2,027,731(A).

By coemulsifying the aforesaid compound with a corresponding coupler in an amount of usually from 5 to 100% by weight to the coupler and adding it to the light-sensitive layer, the object thereof can be attained.

For preventing the deterioration of cyan dye images by heat, and particularly light, it is effective to incorporate a ultraviolet absorbent in the cyan coloring layer and layers adjacent both sides of the cyan coloring layer.

The ultraviolet absorbent, include benzotriazole compounds substituted by an aryl group described, e.g., in U.S. Pat. No. 3,533,794; 4-thiazolidone compounds described, e.g., in U.S. Pat. Nos.3,314,794 and 3,352,681; benzophenone compounds described, e.g., in JP-A-46-2784; cinnamic acid ester compounds described, e.g., in U.S. Pat. Nos.3,705,805 and 3,707,395; butadiene compounds described, e.g., in U.S. Pat. No. 4,045,229; and benzoccidol compounds described, e.g., in U.S. Pat. Nos. 3,406,070, 3,677,672, and 4,271,307.

Ultraviolet absorptive couplers (e.g., $\alpha$-naphthol series cyan dye-forming couplers) and ultraviolet absorptive polymers may be used.

These ultraviolet absorbents may be mordanted to a specific layer. Among the foregoing compounds, benzotriazole compounds which are substituted by an aryl group are preferred.

Also, it is particularly preferred to use the compounds shown below together with the foregoing couplers. In particular, the use with a pyrazoloazole coupler is preferred.

That is, the use of Compound (F) forming a chemically inert and substantially colorless Compound (F) by chemically bonding with an aromatic amino color developing agent remaining after color development processing and/or Compound (G) forming a chemically inert and substantially colorless compound by chemically combining with the oxidation product of an aromatic amine color developing agent remaining after color development processing is preferred for preventing the formation of stains and other side effects. These side effects are caused by the formation of a colored dye by the reaction of a coupler and a color developing agent or the oxidation product thereof remaining in the photographic layers during the storage of the color images after processing.

A preferred compound as Compound (F) is one which reacts with p-anisidine in the range of the secondary reaction rate constant $k_2$ (in trioctyl phosphate of 80° C.) of from 1.0 liter/mol sec. to $1\times10^{-5}$ liter/mol.sec.

In addition, the secondary reaction rate constant can be measured by the method described in JP-A-63-158545.

If the reaction rate constant $k_2$ is above the aforesaid range, the compound itself becomes instable and is sometimes decomposed by reacting with gelatin and water. On the other hand, if the reaction rate constant $k_2$ is below the aforesaid range, the reaction with a remaining aromatic amino developing agent is delayed, thereby it sometimes becomes impossible to prevent the occurrence of a side effect with a remaining aromatic amine color developing agent.

More preferred examples of compound (F) are represented by following Formula (FI) or (FII).

$$R_1-(A)_n-X \qquad \text{(FI)}$$

$$R_2-\underset{\underset{B}{|}}{C}=Y \qquad \text{(FII)}$$

wherein $R_1$ and $R_2$ each represents an aliphatic group, an aromatic group, or a heterocyclic group; n represents 1 or 0; A represents a group forming a chemical bond by reacting with an aromatic amine color developing agent; X represents a releasable group by reacting with an aromatic amine color developing agent; B represents a hydrogen atom, an aliphatic group, an aromatic group, a heterocyclic group, an acyl group, or a sulfonyl group; and Y represents a group which accelerates the addition of an aromatic amine color developing agent to the compound of Formula (FII). $R_1$ and X or Y and $R_2$ or B may combined with each other to form a cyclic structure.

In the system of chemically bonding with a remaining aromatic amine developing agent, typical reactions are a displacement reaction and an addition reaction.

Examples of the preferred compounds shown by Formulae (FI) and (FII) are described in JP-A-63-158545, JP-A-62-283338, European Patent Application Nos. 298321A and 277589A.

Preferred compounds of Compound (G) forming a chemically inert and colorless compound by chemically bonding with the oxidation product of an aromatic amine developing agent remaining after color development are represented by following formula (GI);

$$R-Z \qquad \text{(GI)}$$

wherein R represents an aliphatic group, an aromatic group, or a heterocyclic group, and Z represents a nucleophilic group or a group releasing a nucleophilic group by being decomposed in a color photographic light-sensitive material.

In the compound shown by Formula (GI), Z is preferably a group having a Pearson's nucleophilic property $^{n}CH_3I$ value (R. G. Pearson, et al, *Journal of American Society*, 90, 319(1968) or a group induced from that group.

Examples of the preferred compound shown by Formula (GI) are described in European Patent Application No. 255722A, JP-A-62-143048, JP-A-62-229145, JP-A-1-230039, JP-A-1-57259, European Patent Application Also, details of the combination of aforesaid Compound (G) and Compound (F) are described in European Patent Application No. 277589A.

The color photographic light-sensitive material for use in this invention may further contain hydroquinone derivatives, aminophenol derivatives, gallic acid derivatives, ascorbic acid derivatives, etc., as a color fog inhibitor.

The color photographic light-sensitive material for use in this invention may contain a water-soluble dye or a dye which becomes water-soluble by photographic processing in a hydrophilic colloid layer as a filter dye or for various purposes such as the prevention of irradiation and halation, etc.

Such dyes include oxonol dyes, hemioxonol dyes, styryl dyes, merocyanine dyes, cyanide dyes, and azo dyes. Among these dyes, oxonol dyes, hemioxonol dyes, and merocyanine dyes are particularly useful.

As a binder or a protective colloid which can be used for the silver halide emulsion layers and the other photographic layers of the photographic light-sensitive material for use in this invention, gelatin is advantageously used and other hydrophilic colloid can be used solely or together with gelatin.

In this invention, the gelatin may be limed gelatin or gelatin treated with an acid. Details of the production process of gelatin are described in Arther Vaise, *The Macromolecular Chemistry of Gelatin,* published by Academic Press, 1964.

In the color photographic light-sensitive material for use in this invention, the total gelatin weight is preferably as small as possible. More specifically, it is preferably 7 g/m$^2$ or less, and more preferably 6.5 g/m$^2$ or less. Further, it is preferably 2 g/m$^2$ or more, and more preferably 3 g/m$^2$ or more from the standpoint of the fim property. As described above, the amount of gelatin as a binder component contained in the photographic material for use in this invention is an importan factor.

As a support for use in this invention, transparent films such as cellulose nitrate films and polyethylene terephthalate films and reflection-type support, which are usually used for photographic light-sensitive materials, can be used. A reflective support is more preferable.

The "reflective support" for use in this invention is a support which allows clear viewing of dye images formed in silver halide emulsion layers on the support by increasing the reflectivity thereof. This reflective support includes a support coated with a hydrophobic resin containing a dispersion of a light-reflective material such as titanium oxide, lead oxide, calcium carbonate, calcium sulfate, etc., or a support composed of a hydrophobic resin containing a dispersion of the light-reflective material. For example, there are barayta-coated paper, a polyethylene-coated paper, a polypropylene series synthetic paper, a transparent support having a reflective layer or using a reflective material, etc. As the transparent support which is used for the foregoing purpose, there are a glass sheet, a polyester film such as a polyethylene terephthalate film, a cellulose triacetate film, a cellulose nitrate film, etc., a polyamide film, a polycarbonate film, a polystyrene film, and a vinyl chloride resin film.

Other reflection type supports include a support having a mirror plate reflective metal surface or a secondary diffusion reflective metal surface. The metal surface has preferably a spectral reflectivity in the visible wavelength region of at least 0.5 or it is preferred to roughen the metal surface or to make the metal surface diffusion reflective using a metal powder. As the metal, aluminum, tin, silver, magnesium or the alloys thereof are used, and the surface thereof may be the surface of a metal plate, a metal foil or a metal thin layer obtained by rolling, vapor deposition, or plating.

Among them, a support obtained by vapor depositing a metal on a base material other than metal is preferred. It is preferable to form a water resisting resin, in particular a thermoplastic resin on the metal surface. Also, in this invention, it is preferred that an antistatic layer is formed on the opposite side of the support to the side having the metal surface. Details of these supports are described in JP-A-61-210346, JP-A-63-24247, JP-A-63-24251, and JP-A-63-24255.

These supports can be properly selected according to the intended purpose.

It is better that the light-reflective material is obtained by sufficiently kneading a white pigment in the presence of a surface active agent. Also, it is preferable to use a white pigment the surface of which was treated with a dihydric to tetrahydric alcohol.

The occupied area ratio (%) per unit area defined for white pigment particles can be obtained most typically by dividing the observed area into unit areas of 6 $\mu$m$\times$6 $\mu$m, which are adjacent to each other, and measuring the occupied area ratio (%) ($R_i$) of the fine particle projected to the unit area. The coefficient of variation of the occupied area ratio (%) can be obtained by $s/\overline{R}$, that is, the ratio of the standard deviation s of $R_i$ to the mean value ($\overline{R}$) of $R_i$. The number of the unit areas being observed is preferably at least 6. Accordingly, the coefficient of variation $s/\overline{R}$ can be obtained by the following formula $$\sqrt{\frac{\sum_{i=1}^{n}(Ri-R)^2}{n-1}} \Big/ \frac{\sum_{i=1}^{n} Ri}{n}$$

In this invention, the coefficient of variation of the occupied area ratio (%) of the fine particles of a pigment is preferably not larger than 0.15, and particularly preferably not larger than 0.12. When the coefficient of variation is less than 0.08, the dispersibility of the pigment particles can be said to be "uniform".

The silver chlorobromide emulsion for use in this invention can be prepared using the methods described in P. Glafkides, *Chimie et Phisique Photographique*, published by Paul Montel Co., 1967, G. F. Duffin, *Photographic Emulsion Chemistry,* published by Focal Press co., 1966, and V. L. Zelikman et al, *Making and Coating Photographic Emulsion*, published by Focal Press co., 1964. That is, the emulsion may be prepared by an acid method, a neutralization method, an ammonium method, etc.

Also, as a system of reacting a soluble silver salt and a soluble halide, a single jet method, a double jet method, or a combination thereof may be used. A so-called reverse mixing method of forming silver halide grains in the presence of an excessive amount of silver ions can also be used. As one system of the double jet method, a so-called controlled double jet method of keeping a constant pAg in liquid phase of forming silver halide grains can also be used. According to that method, a silver halide emulsion containing silver halide grains having a regular crystal form and substantially uniform grain sizes can be obtained.

For adding the foregoing couplers to the light-sensitive layers, various techniques can be applied. Usually, an oil drop-in-water dispersion method known as an oil protect method can be used. After dissolving a coupler in a solvent, the solution is dispersed by emulsification in an aqueous gelatin solution containing a surface active agent. Or, by adding water or an aqueous gelatin solution to a coupler solution containing a surface active agent, an oil drop-in-water dispersion may be formed with a phase inversion.

Also, an alkali-soluble coupler can also be dispersed by a so-called Fischer's dispersion method. After removing a low-boiling organic solvent from the coupler dispersion by distillation, noodle washing, or ultrafiltration, the dispersion is mixed with a photographic emulsion.

It is preferable that the color photographic light-sensitive material for use in this invention is subjected to a color development, a bleach-fix (blix), and wash processing (or stabilization processing). The bleach and fix may be performed separately.

The color developer for use in this invention contains an aromatic primary amine color developing agent. Preferred examples of the color developing agent are p-phenylenediamine derivatives, examples of which are illustrated below, although the developing agent for use in this invention is not limited to them.

D-1: N,N-Diethyl-p-phenylenediamine

D-2: 4-Amino-N,N-diethyl-3-methylaniline

D-3: 4-Amino-N-(β-hydroxyethyl)-N-methylaniline

D-4: 4-Amino-N-ethyl-N-(β-hydroxyethyl)aniline

D-5: 4-Amino-N-ethyl-N-(β-hydroxyethyl)-3-methylaniline

D-6: 4-Amino-N-ethyl-N-(3-hydroxypropyl)-3-methylaniline

D-7: 4-Amino-N-ethyl-N-(4-hydroxybutyl)-3-methylaniline

D-8: 4-Amino-N-ethyl-N-(β-methanesulfonamidoethyl)-3-methylaniline

D-9: 4-Amino-N,N-diethyl-3-(β-hydroxyethyl)-aniline

D-10: 4-Amino-N-ethyl-N-(β-methoxyethyl)-3-methylaniline

D-11: 4-Amino-N-(β-ethoxyethyl)-N-ethyl-3-methylaniline

D-12: 4-Amino-N-(3-carbamoylpropyl-N-n-propyl-3-methylaniline

D-13: 4-Amino-N-(4-carbamoylbutyl-N-n-propyl-3-methylaniline

D-14: N-(4-Amino-3-methylphenyl)-3-hydroxy-pyrrolidine

D-15: N-(4-Amino-3-methylphenyl)-3-(hydroxymethyl)pyrrolidine

D-16: N-(4-Amino-3-methylphenyl)-3-pyrrolidinecarboxamide

Among the foregoing p-phenylenediamine derivatives, compounds D-5, D-6, D-7, D-8, and D-12 are particularly preferred. Also, these p-phenylenediamine derivatives may form salts thereof such as sulfates, hydrochlorides, sulfites, naphthalenedisulfonates, or p-toluenesulfonates.

The amount of the aromatic primary amine color developing agent is preferably from 0.002 mol to 0.2 mol, and more preferably from 0.005 mol to 0.1 mol, per liter of the color developer.

In the practice of the process of the present invention, it is preferred that a color developer substantially containing no benzyl alcohol is used. The term "containing substantially no benzyl alcohol" means that the concentration of benzyl alcohol in the color developer is preferably not more than 2 ml/liter, more preferably not more than 0.5 ml/liter, and most preferably, the color developer contains no benzyl alcohol.

It is more preferable that the color developer for use in this invention contains substantially no sulfite ion. A sulfite ion functions as a preservative for a color developing agent and at the same time has the effect of dissolving silver halide and the effect of reducing the dye-forming efficiency by reacting with the oxidation product of a color developing agent. It is assumed that such an effect is one of the causes of increasing the deviation of photographic characters with continuous processing. In addition, the term "containing substantially no sulfite ion" means that the concentration of the sulfite ion in the color developer is preferably not more than $3.0\times10^{-3}$ mol/liter and most preferably the color developer contains no sulfite ion. For these amounts, a very small amount of a sulfite ion which is used for oxidation prevention of a processing composition kit containing concentrated color developing agent, which is diluted in use, is excluded.

It is preferable as described above that the color developer for use in this invention contains substantially no sulfite ion. Further, it is more preferable that the color developer contains substantially no hydroxylamine. This is true because hydroxylamine has the function as a preservative of the color developer. At the same time, it has a silver development activity, whereby the deviation of the concentration of hydroxylamine has a large influence on the photographic characteristics obtained.

The term "containing substantially no hydroxylamine" means that the concentration of hydroxylamine in the color developer is not more than $5.0\times10^{-3}$ mol/liter and most preferably the color developer contains no hydroxylamine.

The color developer for use in this invention more preferably contains organic preservatives in place of the aforesaid hydroxylamine and sulfite ions.

The organic preservatives include all the organic compounds capable of reducing the deteriorating rate of an aromatic primary amine color developing agent by adding to the color developer for developing color photographic light-sensitive materials. That is, they are organic compounds having the function of preventing the oxidation of the color developing agent by air, etc., and in these organic compounds, hydroxylamine derivatives (excluding hydroxylamine, and so forth), hydroxamic acids, hydrazines, hydrazides, phenols, α-hydroxyketones, α-aminoketones, saccharide, monoamines, diamines, polyamines, quaternary ammonium salts, nitroxy radicals, alcohols, oximes, diamide compounds, condensed ring type amines, etc., are particularly effective. These organic preservatives are disclosed in JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, JP-A-52-143020, JP-B-48-30496, and U.S. Pat. Nos. 3,615,503 and 2,494,903.

Also, various kinds of metals described in JP-A-57-44148 and JP-A-57-53749, salicylic acids described in JP-A-59-180588, alkanolamines described in JP-A-54-3532, polyethyleneimines described in JP-A-56-94349, aromatic polyhydroxy compounds described in U.S. Pat. No. 3,746,544, etc., may be, if necessary, incorporated in the color developer as additional preservatives. The addition of alkanolamines such as triethanolamine, etc., dialkylhydroxylamines such as diethylhydroxylamine, etc., hydrazine derivatives, or aromatic polyhydroxy compounds, is particularly preferred.

Among the foregoing organic preservatives, hydroxylamine derivatives and hydrazine derivatives (hydrazines and hydrazides) are particularly preferred, and the details thereof are described in JP-A-1-97953, JP-A-1-186939, JP-A-1-186940, JP-A-1-187557, etc.

Also, it is more preferable for the improvement of the stability of the color developer and the improvement of the stability thereof in continuous processing to use the foregoing hydroxylamine derivatives or hydrazine derivatives together with amines.

The foregoing amines include cyclic amines described in JP-A-63-239447, the amines as described in JP-A-63-128340, and the amines as described in JP-A-1-186939 and JP-A-1-187557.

In the present invention, the color developer contains therein a chloride ion in an amount of preferably from $3.5\times10^{-2}$ to $2.5\times10^{-1}$ mol/liter, and particularly preferably from $4\times10^{-2}$ to $2.0\times10^{-1}$ mol/liter.

If the chloride ion concentration is higher than $2.5\times10^{-1}$ mol/liter, the development is delayed and the object of the present invention that a high maximum density is obtained by quick processing is, undesirably, not attained. Also, if the concentration is less than $3.5\times10^{-2}$ mol/liter, it is undesirable from the point of view of inhibiting the occurrence of fog.

In the present invention, the color developer contains a bromide ion in an amount cf preferably from $3.0\times10^{-5}$ mol/liter to $1.0\times10^{-3}$ mol/liter, and more preferably from $5.0\times10^{-5}$ mol/liter to $5\times10^{-4}$ mol/liter. If the bromide ion concentration is higher than $1.0\times10^{-3}$ mol/liter, the development is delayed and the maximum density and the sensitivity are reduced. While if the bromide ion concentration is less than $3.0\times10^{-5}$ mol/liter, fog is likely to occur.

In this invention, the chloride ion and the bromide ion may be directly added to the color developer or may be dissolved out in a color developer from the color photographic material during the development process.

When a chloride ion is directly added to the color developer, that chloride ion supplying material may be sodium chloride, potassium chloride, ammonium chloride, lithium chloride, nickel chloride, magnesium chloride, manganese chloride, calcium chloride, and cadmium chloride. Among these materials, sodium chloride and potassium chloride are preferred.

Also, the chloride ion may be supplied from an fluorescent whitening agent added to the color developer.

As a bromide ion-supplying material, there are sodium bromide, potassium bromide, ammonium bromide, lithium bromide, calcium bromide, magnesium bromide, manganese bromide, nickel bromide, cadmium bromide, cerium bromide, and thallium bromide. Among these materials, potassium bromide and sodium bromide are preferred.

When these ions are dissolved out from the color photographic material during development, the chloride ion and the bromide ion may be supplied from silver halide emulsions or other elements.

The pH of the color developer for use in this invention is preferably from 9 to 12, and more preferably from 9 to 11.0.

The color developer can further contain other component compounds.

For maintaining the foregoing pH of the color developer in a suitable range, various buffers can be preferably used. Examples of the buffer used include carbonates, phosphates, borates, tetraborates, hydroxybenzoates, glycyl salts, N,N-dimethylglycine salts, 1-leucine salts, norleucine salts, guanine slats, 3,4-dihydroxyphenylaranine salts, aranine salts, aminobutyrates, 2-amino-2-methyl-1,3-propandiol salts, valine salts, proline salts, trishydroxyaminomethane salts, and lysine salts. In particular, carbonates, phosphates, tetraborates, and hydroxybenzoates are excellent in solubility and a buffer function at a high pH range of at least 9.0, do not have a bad influence (fog, etc,) on the photographic performance when they are added to the color developer, and are inexpensive. Thus, they can be preferably used as the buffer.

Examples of these buffers are sodium carbonate, potassium carbonate, sodium bicarbonate, potassium bicarbonate, sodium tertiary phosphate, potassium tertiary phosphate, sodium secondary phosphate, potassium secondary phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate) and potassium 5-sulfo-2-hydroxybenzoate (potassium 5-sulfosalicylate), although the invention is not limited to these compounds.

The addition amount of the buffer to the color developer is preferably at least 0.1 mol/liter, and particularly preferably from 0.1 mol/liter to 0.4 mol/liter.

Moreover, the color developer for use in this invention can contain various chelating agents as a precipitation inhibitor of calcium and magnesium or for improving the stability of the color developer. Examples of the chelating agent are nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, transcyclohexanediaminetetraacetic acid, 1,2-diaminopropanetetraacetic acid, glycol ether diaminetetraacetic acid, ethylenediamine orthohydroxyphenylacetic acid, 2-phosphonobutane-1,2,4-tricarboxylic acid, 1-hydroxyethylidene-1,1-diphosphonic acid, and N,N'-bis(2-hydroxybenzyl)ethylenediamine-N,N'-diacetic acid.

If necessary, these chelating agents may be used as a mixture of two or more.

The addition amount of the chelating agent may be one sufficient to block metal ions in the color developer and is, for example, from about 0.1 g to 10 g per liter of the color developer.

The color developer can, if necessary, contain an optional development accelerator. Examples of the development accelerator include thioether series compounds disclosed in JP-B-37-16088, JP-B-37-5987, JP-B-38-7826, JP-A-44-12380, and JP-A-45-9019, and U.S. Pat. No. 3,813,247; p-phenylenediamine series compounds disclosed in JP-A-52-49829 and JP-A-50-15554; quaternary ammonium salts disclosed in JP-A-50-137726, JP-A-56-156826, JP-A-52-43429, and JP-B-44-30074; amine series compounds disclosed in U.S. Pat. Nos. 2,494,903, 3,128,182, 4,230,796, 3,253,919, 2,482,546, 2,596,926, and 3,582,346, and JP-B-41-11431; polyalkylene oxides disclosed in JP-B-37-16088, JP-B-42-25201, JP-B-41-11431, U.S. Pat. Nos.3,128,183 and 3,532,501.

Also, 1-phenyl-3-pyrazolidones, imidazoles, etc., can be, if necessary, used as the development accelerator.

In this invention, if necessary, an optional antifoggant can be added to the color developer. Suitable antifoggants include alkali metal halides such as sodium chloride, potassium bromide, potassium iodide, etc., and organic antifoggants. The organic antifoggants include, for example, nitrogen-containing heterocyclic compounds such as benzotriazole, 6-nitrobenzimidazole, 5-nitroisoindazole, 5-methylbenzotriazole, 5-nitrobenzortiazole, 5-chloro-oenzotriazole, 2-thiazolyl-benzimidazole, 2-thiazolylmethyl-benzimidazole, indazole, hydroxyazaindolizine, and adenine.

It is preferable that the color developer contains a fluorescent whitening agent. As the fluorescent whitening agent, 4,4'-diamino-2,2'-disulfostilbene series compounds are preferably used. The addition amount of the fluorescent whitening agent is from 0 to 5 g/liter, and preferably from 0.1 g/liter to 4 g/liter.

Also, if necessary, the color developer may further contain various surface active agents such as alkylsulfonic acids, arylsulfonic acids, aliphatic carboxylic acids, aromatic carboxylic acids, etc.

The processing temperature of the color developer in this invention is from 30° C. to 50° C., and preferably from 35° C. to 50° C. The processing time is from 5 seconds to 20 seconds, and preferably from 5 seconds to 15 seconds.

The amount of the replenisher for the developer is preferably low, but is properly from 20 ml to 600 ml, and preferably from 30 ml to 100 ml per square meter of the color photographic material being processed.

When the amount of the replenisher is reduced, it is preferable to prevent the evaporation of the liquid and the occurrence of air oxidation by reducing the contact area between the processing solution and air. The contact area of the processing solution in a processing tank with air can be shown by an opening ratio defined below.

Opening ratio = A/B

A: Contact area ($cm^2$) of a processing solution with air

B: Volume ($cm^3$) of the processing solution

The foregoing opening ratio is preferably 0.1 or lower, and more preferably from 0.001 to 0.05.

The methods of reducing the opening ratio as described above include a method of forming a shielding material such as a floating lid, etc., on the surface of the processing solution in a processing tank, a method of using a movable lid described in JP-A-1-82033, and a slit processing method described in JP-A-63-216050.

It is preferred that the manner of reducing the opening ratio is applied not only to the color development step or the black and white development step but also to subsequent steps such as bleaching, blixing, fixing, washing, stabilization, etc.

Also, by using a means of restraining the accumulation of bromide ions in the color developer, the amount of the replenisher can be reduced.

The desilvering step generally comprises a bleach step and a fix step, a fix step and a blix step, a bleach step and a blix step, a blix step, etc.

As the bleaching agent which is used for the bleach solution or a blix solution, any bleaching agents can be used. However, preferred agents are organic complex salts of iron (III) (e.g., complex salts of aminopolycarboxylic acids such as ethylenediaminetetraacetic acid, diethylenetriaminepentaacetic acid, etc., and organic phosphonic acids such as aminopolyphosphonic acid, phosphonocarboxylic acid, etc.); organic acids such as citric acid, tartaric acid, malic acid, etc.; persulfates; hydrogen peroxide, etc,, are preferably used.

Among the foregoing compounds, the organic complex salts of iron(III) are particularly preferred for quick processing and preventing environmental pollution. The aminopolycarboxylic acids, aminopolyphosphonic acids, or organic phosphonic acids useful for forming the organic complex salts of iron(III) include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, glycol ether diaminetetraacetic acid, etc. These compounds may form sodium salts, potassium salts, lithium salts, or ammonium salts.

Among these compounds, iron(III) complex salts of ethylenediaminetetraacetic acid, diethylenetriaminepentaacetic acid, cyclohexanediaminetetraacetic acid, 1,3-diaminopropanetetraacetic acid, and methyliminodiacetic acid are preferred owing to their high bleaching power.

These ferric ion complex salts may be used in the form of complex salts or ferric ion complex salts may be in a solution using, e.g., ferric salts such as ferric sulfate, ferric chloride, ferric nitrate, ammonium ferric sulfate, ferric phosphate, etc., and chelating agents such as aminocarboxylic acids, aminopolyphosphonic acids, phosphonocarboxylic acids, etc, Also, a chelating agent may be used in an amount excessive to that needed for formation of the ferric ion complex salt. Among the iron complex salts, aminopolycarboxylic acid iron complex salts are preferred and the addition amount thereof is from 0.01 mol/liter to 1.0 mol/liter, and preferably from 0.05 mol/liter to 0.50 mol/liter.

For the bleach solution, blix solution and/or the prebath thereof, various compounds can be used as the bleach accelerator. For example, the compounds having a mercapto group or a disulfide bond described in U.S. Pat. No. 3,893,858, German Patent 1,290,812, JP-A-53-95630, and *Research Disclosure*, No. 17129 (July, 1978), thiourea series compounds described in JP-B-45-8506, JP-A-52-20832, JP-A-53-32735, and U.S. Pat. No. 3,706,561, or halogen compounds such as iodide ions, bromide ions, etc., have an excellent bleaching power.

Furthermore, the bleach solution or the blix solution can contain a re-halogenating agent such as bromides (e.g., potassium bromide, sodium bromide, and ammonium bromide), chlorides (e.g., potassium chloride, sodium chloride, and ammonium chloride) and iodides (e.g., ammonium iodide). If necessary, the bleach solution or the blix solution may contain a corrosion inhibitor such as inorganic acids, organic acids and the alkali metal salts thereof or ammonium salts thereof, such as borax, sodium metaborate, acetic acid, sodium acetate, sodium carbonate, potassium carbonate, phosphorous acid, phosphoric acid, sodium phosphate, citric acid, sodium citrate, tartaric acid, ammonium nitrate, etc., and guanidine.

Known fixing agents can be used for the blix solution or the fix solution. That is, they are water-soluble silver halide dissolving agents, for example, thiosulfates such as sodium thiosulfate, ammonium thiosulfate, etc.; thiocyanates such as sodium thiocyanate, ammonium thiocyanate, etc ; thioether compounds such as ethylenebisthioglycolic acid, 3,6-dithia-1,8-octanediol, etc., and thioureas. They can be used either singly or as a mixture thereof.

Also, a specific blix solution composed of a combination of a fixing agent and a large amount of a halide such as potassium iodide as described in JP-A-55-155354 can be used in this invention.

In this invention, the use of a thiosulfate, in particular ammonium thiosulfate, is preferred.

The amount of the fixing agent is preferably from 0.2 mol to 2 mols, and more preferably from 0.3 mol to 1.0 mol, per liter of the blix solution or fix solution. Also, the pH range of the blix solution or fix solution is preferably from 3 to 9, and particularly preferably from 4 to 8.

The blix solution can further contain various fluorescent whitening agents, defoaming agents or surface active agents, or organic solvents such as polyvinylpyrrolidone, methanol, etc.

It is preferred that the blix solution or the fix solution contains sulfite ion-releasing compounds such as sulfites (e.g., sodium sulfite, potassium sulfite, and ammonium sulfite), bisulfites (e.g., ammonium bisulfite, sodium bisulfite, potassium bisulfite, etc.), metabisulfites (e.g., potassium metabisulfite, sodium metabisulfite, and ammonium metabisulfite), etc., as preservatives.

The addition amount of these compounds is preferably from about 0.02 mol/liter to 1.0 mol/liter, and more preferably from 0.04 mol/liter to 0/6 mol/liter, converted as sulfite ion.

As the preservative, a sulfite is generally used but ascorbic acid, a carbonyl-bisulfite addition product, or a carbonyl compound may also be used.

Furthermore, a buffer, a chelating agent, an antimold, etc., may be, if necessary, added to the blix solution or the fix solution.

After a desilvering processing such as fixing or blixing, etc., the photographic material is generally washed and/or stabilized.

The amount of wash water in the wash step can be selected from a wide range according to the components of the material (e.g., by the elements being used, such as couplers, etc.) and the uses of the photographic light-sensitive material, the temperature of wash water, the number (stage number) of wash tanks, a replenishing system such as countercurrent system, regular current system, etc., and various other conditions. The relation between the number of wash tanks and the amount of wash water in a multistate countercurrent system can be obtained by the method described in *Journal of the Society of Motion Picture and Television Engineers,* Vol. 64, 248–253(May, 1955).

The stage number in the multistage countercurrent system is preferably from 2 to 6, and particularly preferably from 2 to 5.

According to the multistate countercurrent system, the amount of wash water can be greatly reduced. For example, the amount of wash water can be reduced below 0.5 liter per square meter of the photographic light-sensitive material, and the effect of this invention is remarkable in that case. However, with an increase of residence time of water in the tanks, bacteria grow to cause the problem of floating materials attaching to the photographic light-sensitive materials, etc.

For solving such a problem, a method of reducing the calcium and magnesium content described in JP-A-62-288838 can be very effectively employed. Also, isothiazolone compounds and thiabendazoles described in JP-A-57-8542, chlorine series fungicides such as chlorinated sodium isocyanurate described in JP-A-61-120145, benzotriazole, copper ions, etc., described in JP-A-61-267761, and the fungicides described in Hiroshi Horiguchi, *Bokin Bobai no Kagaku* (*Antibacterial and Antifungal Chemistry*), published by Sankyo Shuppan K.K., 1986, *Biseibutsu no Mekkin Sakkin Bobai Gijutsu* (*Antibacterial and Antifungal Techniques of Microorganisms*), edited by Eisei Gijutsu Kai, published by Kogyo Gijutsu Kai, 1982, *Bokin Bobai Zai Jiten (Antibacterial and Antifungal Agents Hand Book*) edited by Nippon Bokin Bobai Gakkai, 1986 can be also used in this invention.

Furthermore, wash water can contain a surface active agent as a wetting agent and a chelating agent such as ethylenediaminetetraacetic acid (EDTA) as a hard water softener.

In this invention, the photographic light-sensitive material can be processed by a stabilizing solution after the wash step or without using a wash step.

The stabilizing solution contains a compound having the function of stabilizing color images formed. These compounds include aldehyde compounds such as formalin, etc., a buffer for adjusting film to a pH suitable for the stabilization of dyes, and ammonium compounds. Also, the stabilizing solution can contain the foregoing antibacterial agents and antifungal agents for preventing the growth of bacteria in the solution and imparting an antifungal property to the photographic light-sensitive material after processing.

Moreover, the stabilizing solution can also contain a surface active agent, a fluorescent whitening agent and a hardening agent.

When, in processing of photographic light-sensitive materials according to this invention, the stabilization is directly carried out without employing a wash step, the methods described in JP-A-57-8543, JP-A-58-14834, and JP-A-60-220345 can be all used.

It is also preferred to use a chelating agent such as 1-hydroxyethylidene-1,1-diphosphonic acid, ethylenediaminetetramethylenephosphonic acid, etc., or a magnesium or bismuth compound in the stabilizing solution.

As a wash solution or stabilizing solution being used after desilvering step, a so-called rinse solution is similarly used.

The pH of the solution for the wash step or the stabilization step is preferably from 4 to 10, and more preferably from 5 to 8. The temperature can be variously selected according to the use, the components, etc., of the photographic light-sensitive material but is generally from 20° C. to 50° C., and preferably from 25° C. to 45° C. The time can be optionally selected, but a shorter time is desirable from the view point of reducing the whole processing time. The time for the wash step or stabilization step is preferably from 10 seconds to 60 seconds, more preferably from 15 seconds to 45 seconds.

The amount of the replenisher for the step is preferably low from the view points of running cost, the reduction of the discharging amount of the waste solution, the handling property, etc.

The practical amount of the replenisher is from 0.5 times to 50 times, and preferably from 3 times to 40 times, the carried amount of the solution from the prebath per unit area of the photographic light-sensitive material being processed. Also, the replenisher may be replenished continuously or intermittently.

The solution used for the wash step and/or the stabilization step can be further used for the previous processing step. An example thereof is a method wherein the overflowed solution of the wash water the amount of which is reduced by a multistage countercurrent system is introduced into the pre-bath, i.e., a blix bath and a condensed blix solution is replenished to the blix bath, whereby the amount of wash solution is reduced.

For completing color images by very quick processing of this invention, it is desirable that the drying time is from 10 seconds to 40 seconds.

Means for shortening the drying time include a means by which the drying time can be reduced by reducing the amount of water carried in the photographic layers of the light-sensitive material by reducing the amount of a hydrophilic binder such as gelatin.

Also, from the view point of reducing the carried amount of water, the drying time can be reduced by removing water by squeezing rollers or a cloth from the photographic light-sensitive material emerging from the wash bath.

To improve the drying machine, the drying time can be reduced by increasing the drying temperature and/or increasing the speed of the drying blast. Furthermore, the drying time can also be reduced by adjusting the blowing angle of the drying blast onto the photographic light-sensitive material or by improving the removing method of the discharged blast.

The silver halide color photographic material being processed by the process of this invention may contain therein a color developing agent for simplifying and quickening processing. For incorporating a color developing agent in the light-sensitive material, it is preferred to use various precursors for a color developing agent. Examples of such precursors are the indoaniline series compounds described in U.S. Pat. No. 3,342,597, the Schiff base type compounds described in U.S. Pat. No. 3,342,599 and *Research Disclosures,* No. 14850 and No. 15159, the aldol compounds described in *Research Disclosure,* No. 13924, the metal complexes described in U.S. Pat. No. 3,719,492, and the urethane series compounds described in JP-A-53-135628.

The silver halide color photographic material being processed in this invention may contain, if necessary, various kinds of 1-phenyl-3-pyrazolidones for accelerating color development. Typical examples of these compounds are described in JP-A-56-64339, JP-A-57-144547, and JP-A-58-115438.

Also, for saving silver in the photographic light-sensitive material, the process of using a cobalt intensification or a hydrogen peroxide intensification described in West German Patent 2,226,770 and U.S. Pat. No. 3,674,499 may be employed.

The invention is now described more practically by the following examples, but the invention is not limited to them.

EXAMPLE 1

Preparation of Support

A support was prepared by forming a white pigment-containing resin layer having the following composition on the surface of a white base paper for photographic paper composed of 100% LBKP (broadleaf tree bleached sulfate pulp) (basis weight 175 g/m$^2$, thickness: about 180 μm).

That is, to 90 parts by weight of a polyethylene composition (density 0.920 g/m$^2$, melt index (MI): 5.0 g/10 min.) was added 16 parts by weight of a titanium oxide white pigment obtained by surface treating titanium oxide with silicon oxide and aluminum oxide and after further adding thereto a bluish dye (ultramarine blue) followed by kneading. The kneaded mixture was coated on the white paper by melt extrusion to form a waterproof resin layer of 30 μm in thickness. On the other hand, another polyethylene composition alone (density 0.950 g/cm$^2$, MI: 18.0/10 min.) was coated on the back surface of the white paper to form a waterproof resin layer of 30 μm in thickness.

Preparation of Silver Halide Emulsion A-1

To 800 ml of distilled water was added 25 g of limed gelatin. After dissolving the gelatin at 40° C., the pH thereof was adjusted to 3.8 with sulfuric acid. In the aqueous solution was dissolved 2.0 g of sodium chloride and 0.01 g of N,N'-dimethylethylenethiourea to provide Aqueous Solution (I). Then, 100 g of silver nitrate was dissolved in 400 ml of distilled water to provide Aqueous Solution (II-a) and 34.5 g of sodium chloride was dissolved in 400 ml of distilled water to provide Aqueous Solution (III-a).

Then, 25 g of silver nitrate was dissolved in 100 ml of distilled water to provide Aqueous Solution (II-b), and 8.5 g of sodium chloride was dissolved in 500 ml of distilled water to provide Aqueous Solution (III-b).

Then, after simultaneous by adding aqueous solution (II-a) and aqueous solution (III-a) to aqueous solution (I) kept at 52° C. over a period of 40 minutes followed by mixing, aqueous solution (II-b) and aqueous solution (III-b) are simultaneously added thereto over a period of 10 minutes, followed by mixing.

After removing excessive salts by a flocculation method from the dispersion of silver halide grains obtained by the foregoing operation, 76 g of limed gelatin was dispersed therein.

The dispersion was spectrally sensitized with the addition of Spectral Sensitizing Dye (V-1) shown below in an amount of $4.6\times10^{-4}$ mol per mol of silver halide. While forming silver bromide on the silver chloride grains already formed by a halogen conversion method, a sulfur sensitization was performed thereon using N,N,N'-triethylthiourea.

(V-1)

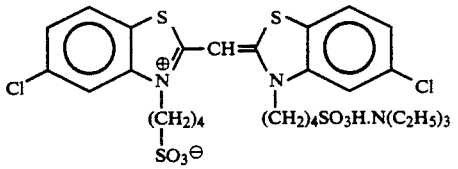

By the aforesaid method, cubic grain silver chlorobromide emulsion (A-1) having a mean grain size of 0.58 μm, a variation coefficient of 0.09, and a silver chloride content of 99.5 mol % was prepared.

Preparation Silver Halide Emulsion (B-1)

By following the same procedure as in the preparation silver halide Emulsion (A-1) except that following Spectral Sensitizing Dyes (V-2) and (V-3) were used in place of the Spectral Sensitizing Dye (V-1) in amounts of $4.2\times10^{-4}$ mol and $7.2\times10^{-5}$ mol, respectively. By controlling the time, temperature, and stirring method of adding and mixing aqueous solutions (I), (II-a), (II-b), (III-a), and (III-b) used in the preparation of Emulsion (A-1), cubic silver halide Emulsion (B-1) having a mean grain size of 0.52 μm, a variation coefficient of 0.08, and a silver chloride content of 99.6 mol %, was prepared.

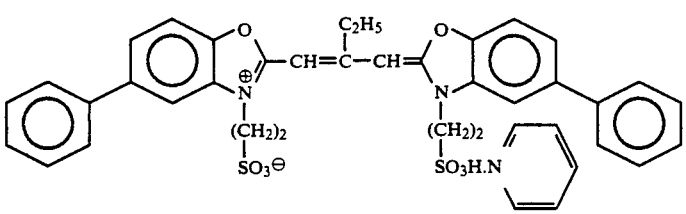

(V-2)

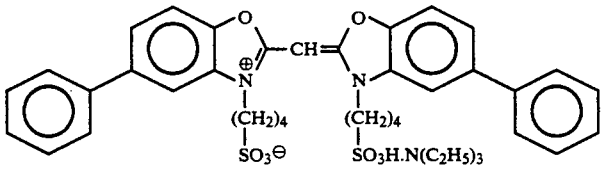

(V-3)

Preparation of Silver Halide Emulsion C-1

By following the same procedure as in the preparation of silver halide Emulsion (A-1) except that following Spectral Sensitizing Dye (V-4) was used in place of Spectral Sensitizing Dye (V-1) in an amount of $7.4\times10^{-5}$ per mol of silver halide. By controlling the time, temperature, and stirring method of the addition and mixing the aqueous solutions (I), (II-a), (II-b), (II-a), and (III-b), cubic silver chlorobromide Emulsion (C-1) having a mean grain size of 0.49 μm, a variation coefficient of 0.07, and a silver chloride content of 99.6 mol %, was prepared.

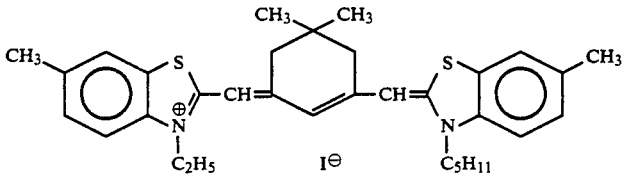

(V-4)

Preparation of Silver Halide Emulsion A-2

By following the same procedure as in the preparation of silver halide Emulsion (A-1) except that a potassium ferrocyanide was added aqueous solutions (III-a) and (III-b) in the amounts of 12.4 mg and 3.1 mg, respectively, silver halide Emulsion (A-2) uniformly containing an iron compound in an amount of $5\times10^{-5}$ mol per mol of silver was prepared. The grain form, the mean grain size, and the grain size distribution of emulsion (A-2) were almost same as these of Emulsion (A-1).

Preparation of Silver Halide Emulsion A-3)

By following the same procedure as in the preparation of silver halide Emulsion (A-1) except that 15.5 mg of a potassium ferrocyanide was added to aqueous solution (III-b), silver halide Emulsion (A-3) containing an iron compound in an amount of $5\times10^{-5}$ mol per mol of silver in the surface layer of 20% by volume from the surface, was prepared. The grain form, the mean grain size, and the grain size distribution of Emulsion (A-3) were almost same as those of Emulsion (A-1).

Preparation of Silver Halide Emulsions [A-4 to A-9)

By controlling the time, the temperature, and the stirring method of the addition and mixing of aqueous solutions (I), (II-a), (II-b), (III-a), (III-b), controlling the amounts of silver nitrate and sodium chloride being used in aqueous solutions (II-a), (II-B), (III-a), and (III-b), and further controlling the addition amount of the potassium ferrocyanide to the aqueous solution (III-a) and/or aqueous solution (III-b), silver halide Emulsions (A-4) to (A-9) shown in Table 1 below were prepared.

TABLE 1

| Emulsion No. | Fe ion concentration × $10^{-5}$ mol to silver: Internal Phase | Surface Phase | Average | Volume Ratio of Surface Phase | Remarks |
|---|---|---|---|---|---|
| A-1 | 0 | 0 | 0 | Uniform | Comprison |
| A-2 | 5 | 5 | 5 | Uniform | Comparison |
| A-3 | 0 | 25 | 5 | 20 | Invention |
| A-4 | 0 | 12.5 | 5 | 40 | Invention |
| A-5 | 0 | 50 | 5 | 10 | Invention |
| A-6 | 2.5 | 15 | 5 | 20 | Invention |
| A-7 | 3.2 | 12 | 5 | 20 | Comparison |
| A-8 | 0 | 2.5 | 0.5 | 20 | Invention |
| A-9 | 0 | 0.25 | 0.05 | 20 | Comparison |

Preparation of Light-Sensitive Material (101) to (109)

A multilayer color photographic paper having the layer structure shown below was prepared by coating coating compositions on the waterproof paper support prepared as described above. The coating compositions were prepared as follows.

Preparation of coating Composition for Layer 1

In a solvent mixture of 27.2 ml of ethyl acetate, 5.5 g of solvent (Solv-1), and 2.7 g of solvent (Solv-3) were dissolved 19.1 g of yellow coupler (ExY); 4.4 g of color image stabilizer (Cpd-1), and 0.7 g of color image stabilizer (Cpd-7). The solution was dispersed by emulsification in 185 ml of an aqueous 10% gelatin solution containing 8 ml of an aqueous solution of 10% sodium dodecylbenzenesulfonate.

The emulsified dispersion was mixed with the aforesaid silver halide Emulsion (A-1) to provide a coating composition for Layer 1 having the composition shown below.

The coating compositions for Layer 2 to Layer 7 were also prepared by the methods similar to that used for preparing the coating composition for Layer 1.

In each layer was included 1-oxy-3,5-dichloro-s-triazine sodium salt.

To the red-sensitive emulsion layer was added the following compound in an amount of $2.6\times10^{-3}$ mol per of silver halide.

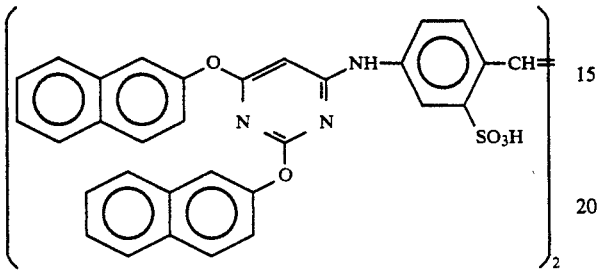

Also, to the blue-sensitive emulsion layer, the green-sensitive emulsion layer, and the red-sensitive emulsion layer was added 1-(5-methylureidophenyl)-5-mercaptotetrazole in the amount of $8.5\times10^{-5}$ mol, $7.7\times10^{-4}$ mol and $2.5\times10^{-4}$ mol, respectively, per mol of silver halide.

Also, to the blue-sensitive emulsion layer and the green-sensitive emulsion layer was added 4-hydroxy-6-methyl-1,3,3a,7-tetraazaindene in the amount of $1\times10^{-4}$ mol and $2\times10^{-2}$ mol, respectively, per mol of silver halide.

Also, irradiation inhibition, the following dyes were added to each emulsion layer.

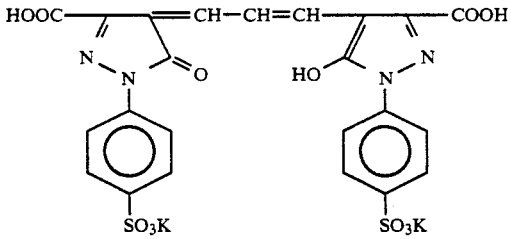

and

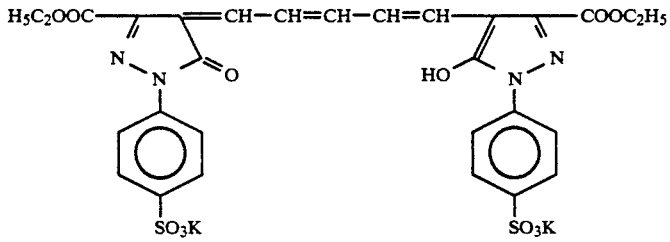

Layer Structure

The composition of each layer is shown below, wherein the numeral represents the coating amount ($g/m^2$), and in the case of each silver halide emulsion, the numeral represents the coating amount converted as silver.

| Support Polyethylene laminate paper | |
|---|---|
| Layer 1 (Blue-Sensitive Emulsion Layer) | |
| Emulsion (A-1) | 0.25 |
| Gelatin | 0.98 |
| Yellow Coupler (ExY) | 0.72 |
| Color Image Stabilizer (Cpd-1) | 0.17 |
| Solvent (Solv-1) | 0.21 |
| Solvent (Solv 3) | 0.10 |
| Color Image Stabilizer (Cpd-7) | 0.05 |
| Layer 2 (Color Mixing Inhibition Layer) | |
| Gelatin | 0.75 |
| Color Mixing Inhibitor (Cpd-5) | 0.08 |
| Solvent (Solv-1) | 0.16 |
| Solvent (Solv-4) | 0.08 |
| Layer 3 (Green-Sensitive Emulsion Layer) | |
| Emulsion (B-1) | 0.13 |
| Gelatin | 0.94 |
| Magenta Coupler (ExM) | 0.26 |
| Color Image Stabilizer (Cpd-2) | 0.05 |
| Color Image Stabilizer (Cpd-3) | 0.08 |
| Color Image Stabilizer (Cpd-4) | 0.02 |
| Color Image Stabilizer (Cpd-9) | 0.02 |
| Solvent (Solv-2) | 0.40 |
| Layer 4 (Ultraviolet Absorption Layer) | |
| Gelatin | 1.13 |
| Ultraviolet Absorbent (UV-1) | 0.47 |
| Color Mixing Inhibitor (Cpd-5) | 0.05 |
| Solvent (Solv-5) | 0.24 |
| Layer 5 (Red-Sensitive Emulsion Layer) | |
| Emulsion (C-1) | 0.21 |
| Gelatin | 0.80 |
| Cyan Coupler (ExC) | 0.32 |
| Color Image Stabilizer (Cpd-6) | 0.17 |
| Color Image Stabilizer (Cpd-7) | 0.32 |
| Color Image Stabilizer (Cpd-8) | 0.04 |
| Solvent (Solv-6) | 0.20 |
| Layer 6 (Ultraviolet Absorption Layer) | |
| Gelatin | 0.38 |
| Ultraviolet Absorbent (UV-1) | 0.16 |
| Color Mixing Inhibitor (Cpd-5) | 0.02 |
| Solvent (Solv-5) | 0.08 |
| Layer 7 (Protective Layer) | |
| Gelatin | 1.06 |
| Acryl-Modified Copolymer of Polyvinyl Alcohol (modified degree 17%) | 0.08 |
| Fluid paraffin | 0.02 |

The compounds used for the above color photographic paper were as follows.

Yellow Coupler (ExY):
A 1:1 mixture (mol ratio) of
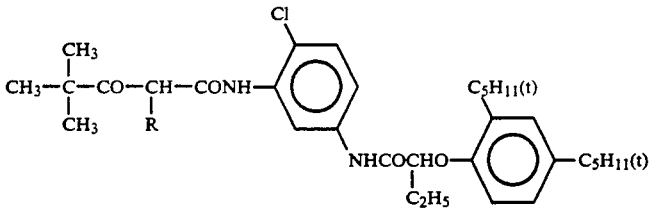
R = 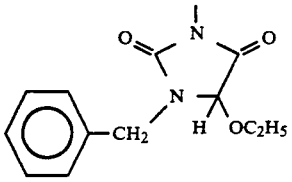 and R = 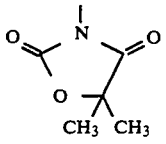
Magenta Coupler (ExM):
A 1:1 mixture (mol ratio) of
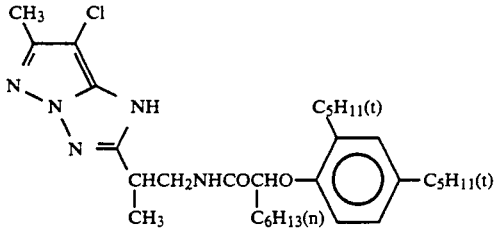
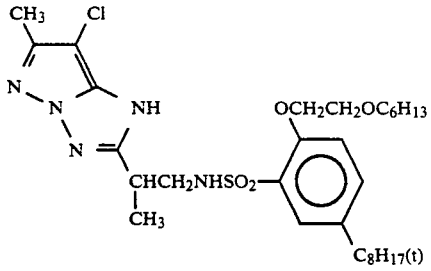
Cyan Coupler (ExC):
A 2:4:4 mixture by weight of
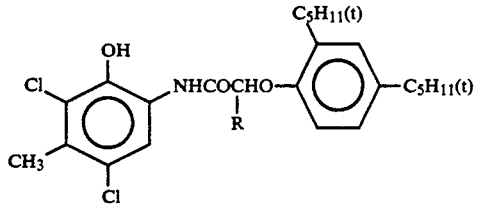
R = $C_2H_5$, $C_4H_9$, and 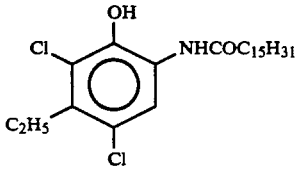
Color Image Stabilizer (Cpd-1):

-continued
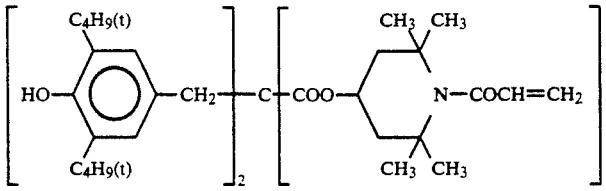
Color Image Stabilizer (Cpd-2):
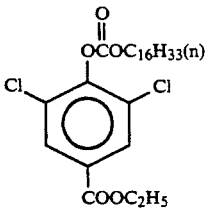
Color Image Stabilizer (Cpd-3):
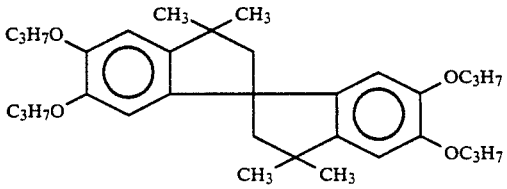
Color Image Stabilizer (Cpd-4):
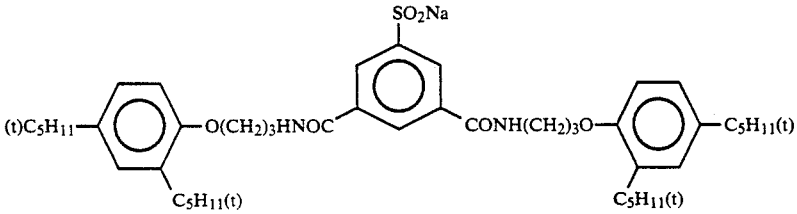
Color Mixing Inhibitor (Cpd-5)
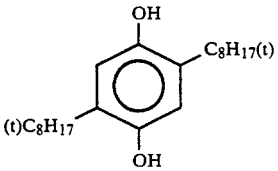
Color Image Stabilizer (Cpd-6)
A 2:4:4 mixture (by weight ratio) of:
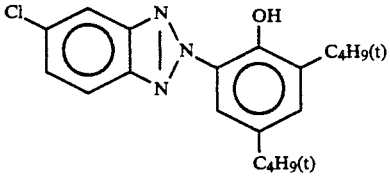
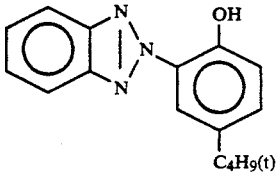

-continued
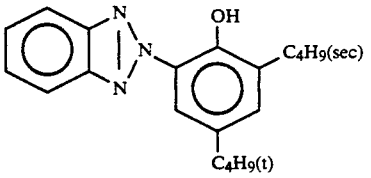
Color Image Stabilizer (Cpd-7):
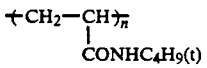
mean molecular weight 60,000
Color Image Stabilizer (Cpd-8):
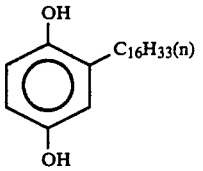
Color Image Stabilizer (Cpd-9):
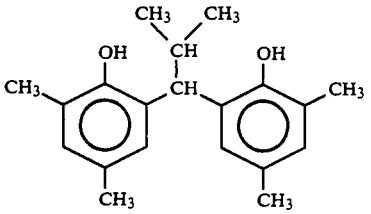
Ultraviolet Absorbent (UV-1):
A 4:2:4 mixture (by weight ratio) of
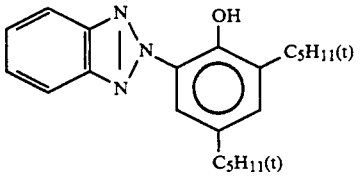
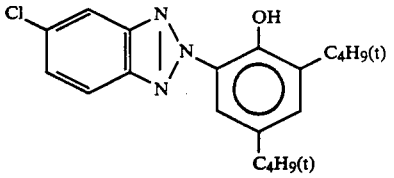
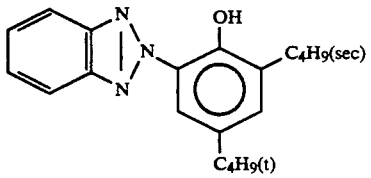
Solvent (Solv-1)
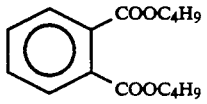
Solvent (Solv-2):
A 2:1 mixture (by volume ratio) of -continued

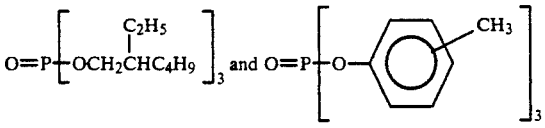

Solvent (Solv-3):

$O{=}P{+}O{-}C_9H_{19}(iso)]_3$

Solvent (Solv-4):

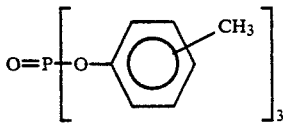

Solvent (Solv-5):

$(CH_2)_8(COOC_8H_{17})_2$

Solvent (Solv-6):

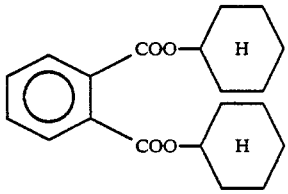

Thus, light-sensitive material (101) was prepared. Then, by following the same procedure as in the preparation of light-sensitive material (101) except that each of silver halide Emulsions (A-2) to (A-9) shown in foregoing Table 1 was used in place of silver halide Emulsion (A-1), each of light-sensitive materials (102) to (109) was prepared.

Evaluation of Light-Sensitive Material

Each of the light-sensitive materials (101) to (109) was subjected to the gradation exposure of a sensitometric 3-color separation filter using an sensitometer (Type FWH, color temperature of light source: 3200° K., made by Fuji Photo Film Co., Ltd.). The exposure was carried out so that the exposure amount was 250 CMS at an exposure time of 0.1 second. The samples thus exposed were processed by following photographic processing (I).

Photographic Processing (I)

| Processing Step | Temperature | Time |
|---|---|---|
| Color Development | 38° C. | 20 sec. |
| Blix | 38° C. | 20 sec. |
| Rinse (1) | 38° C. | 5 sec. |
| Rinse (2) | 38° C. | 5 sec. |
| Rinse (3) | 38° C. | 5 sec. |
| Rinse (4) | 38° C. | 5 sec. |
| Rinse (5) | 38° C. | 5 sec. |
| Drying | 65° C. | 15 sec. |

(The rinse step was by a 5 tank countercurrent system of rinse (5) to rinse (1).)

In addition, each process time in the above steps was the time required for a light-sensitive material from the entrance in one processing solution to the entrance in the subsequent processing solution including the transport time in between the solutions.

The composition of each processing solution was as follows.

| Color Developer | Tank | Replenisher |
|---|---|---|
| Water | 800 ml | 800 ml |
| Ethylenediamine-N,N,N',N'-tetramethylenesulfonic Acid | 2.1 g | 2.1 g |
| Triethanolamine | 8.1 g | 8.1 g |
| Potassium Chloride | 8.2 g | — |
| Potassium Bromide | 0.01 g | — |
| Sodium Sulfite | 0.14 g | 0.14 g |
| Potassium Carbonate | 18.7 g | 37.0 g |
| Compound D-6* | 12.8 g | 27.8 g |
| Diethylhydroxylamine (80%) | 6.3 g | 6.3 g |
| Fluorescent Whitening Agent (4,4-diaminostilbene series) | 0.5 g | 0.5 g |
| Water to make | 1000 ml | 1000 ml |
| pH (25° C.) | 10.05 | 10.95 |

*Compound illustrated hereinbefore as p-phenylenediamine color developing agent.

The replenishing amount of the above developer was 30 ml per square meter of the light-sensitive material.

| Blix solution | Tank Liquid | Replenisher |
|---|---|---|
| Water | 400 ml | 400 ml |
| Ammonium Thiosulfate (70%) | 100 ml | 250 ml |
| Ethylenediaminetetraacetic acid | 3.4 g | 8.5 g |
| Ethylenediaminetetraacetic Acid Iron(III) Ammonium. dihydrate | 73.0 g | 183 g |
| Ammonium Sulfite | 40 g | 100 g |
| Ammonium Bromide | 20.0 g | 50.0 g |
| Nitric Acid (67%) | 9.6 g | 24 g |
| Water to make | 1000 ml | 1000 ml |

-continued

| Blix solution | Tank Liquid | Replenisher |
|---|---|---|
| pH (25° C.) | 5.80 | 5.10 |

The replenisher amount of the solution described above was 30 ml per square meter of the photographic light-sensitive material.

Rinse Solution

Ion-exchanged water was sued for the tank solution and the replenisher and the amount of the replenisher was 55 ml/m$^2$.

For photographic processing in this example, an automatic processor was used. The features of the automatic processor were, (1) each processing bath had a liquid circulating mechanism for blowing the tank liquid onto the surface of the light-sensitive layer of the light-sensitive material at a jetting amount of at least 2 liter per minute, (2) the processor had a mechanism so that the ratio of the surface area of the developer in the color developing bath in contact with air to the whole volume of the development bath was not more than 0.05 cm$^2$/ml, (3) the processor had a mechanism so that in the path between the entrance of the light-sensitive material in the color developing bath and the blixing bath and the entrance in the subsequent bath through the air, the ratio of the time of the material in the air to the time of the material in the processing solution in each bath was not more than 0.7, (4) a plurality of rollers for wiping liquid attached to the surface of the light-sensitive material were disposed between the final rinse bath and the drying section, and (5) the processor had a drying section having an air circulating mechanism for blowing a drying blast onto the surface of the light-sensitive layer of the light-sensitive material through a porous plate or slits at a rate of at least 3 meters/sec. and quickly removing a so-called return wind containing water from the surface of the light-sensitive material.

It was confirmed that by using the foregoing automatic processor, photographic light-sensitive materials could be processed in a very short time, and thus the remarkable effect of this invention became more apparent.

By following the same procedure as aforesaid photographic processing except that the time for color development processing was shortened to 15 seconds, light-sensitive materials (101) to (109) thus processed were evaluated and the reduction of the sensitivity in the yellow (blue-sensitive emulsion layer) colored density of 1.0 was determined on each light-sensitive material. The results are shown in Table 2.

TABLE 2

| Light-Sensitive Material | Sensitivity Reduction by Developing Time Shortening | Remarks |
|---|---|---|
| (101) | 24% | Comparison |
| (102) | 24% | Comparison |
| (103) | 5% | Invention |
| (104) | 12% | Invention |
| (105) | 4% | Invention |
| (106) | 7% | Invention |
| (107) | 19% | Comparison |
| (108) | 8% | Invention |
| (109) | 20% | Comparison |

As is clear from these results, the light-sensitive materials of this invention show less time dependence on color development. That means that in the light-sensitive materials processed according to this invention, uneven development is unlikely to occur because of a difference in local stirring in a development bath.

Also, when uneven images formed during printing several images on the light-sensitive materials followed by processing were observed, it was confirmed that the light-sensitive materials which showed a large sensitivity reduction in Table 2 (i.e., (101), (102), (107) and (109)) were likely to cause uneven images.

COMPARATIVE EXAMPLE 1

By following the same procedure and evaluation as in Example 1 except that the jet stream stirring of the color development bath in photographic processing (I) was stopped and a stirring system without striking the light-sensitive material with a circulating stream was employed instead, the results obtained are shown in Table 3.

TABLE 3

| Light-Sensitive Material | Sensitivity Reduction by Developing Time Shortening | Remarks |
|---|---|---|
| (101) | 54% | Comparison |
| (102) | 52% | Comparison |
| (103) | 44% | Comparison |
| (104) | 47% | Comparison |
| (105) | 40% | Comparison |
| (106) | 46% | Comparison |
| (107) | 48% | Comparison |
| (108) | 47% | Comparison |
| (109) | 49% | Comparison |

As is clear from the results, when a jet stream stirring is not used to the photographic materials prepared according to the present invention, the effect of this invention is greatly reduced. The reason has not yet been clarified but it is believed that when employing jet stream stirring is not used, the supply of the developing agent, etc., onto the surface of the light-sensitive layer of the light-sensitive material is very much delayed. Hence, since the course becomes rate determining, the improvement of the silver halide emulsion grains themselves, which is one of the features of this invention, is not obtained. Therefore, it can be seen that the effect caused by the jet stream stirring which is an essential embodiment of the present invention is important.

EXAMPLE 2

By following the same procedure as in Example 1 except that an equivalent amount of Compound (D-7) was used in place of the color developing agent (D-6), light-sensitive materials (101) to (109) were evaluated. The results revealed that the light-sensitive materials (103), (105), (106) and (108) featured a reduction of sensitivity at shortening the developing time and a good developing progressing property.

EXAMPLE 3

When the light-sensitive materials (101) to (109) were evaluated in the same manner as in Example 1 except that following photographic processing (IV-1) or (IV-2) was applied in place of photographic processing (I), it was confirmed the light-sensitive materials (103), (105), (106), and (108) show good development progressing character as compared with the comparison light-sensitive materials as they did in Example 1.

| Processing step | Process (IV-1) | Process (IV-2) |
|---|---|---|
| Color Development | 40° C. 15 sec. | 40° C. 15 sec. |
| Blix | 40° C. 15 sec. | 40° C. 15 sec. |
| Rinse (1) | 40° C. 7 sec. | 40° C. 7 sec. |
| Rinse (2) | 40° C. 7 sec. | 40° C. 7 sec. |
| Rinse (3) | 40° C. 7 sec. | 40° C. 7 sec. |
| Rinse (4) | 40° C. 7 sec. | 40° C. 7 sec. |
| Rinse (5) | 40° C. 7 sec. | 40° C. 7 sec. |
| Drying | 65° C. 15 sec. | 65° C. 15 sec. |

(5 tank countercurrent system of from rinse (5) to rinse (1) was employed).

The composition of each processing composition was as follows.

| Color Developer | Processing (IV-1) | Processing (IV-2) |
|---|---|---|
| Water | 800 ml | 800 ml |
| Ethylenediaminetetraacetic Acid | 2.0 g | 2.0 g |
| 5,6-Dihydroxybenzene-1,2,4-trisulfonic Acid | 0.3 g | 0.3 g |
| Triethanolamine | 8.0 g | 8.0 g |
| Sodium Chloride | 2.5 g | 2.5 g |
| Sodium Sulfite | 0.3 g | 0.3 g |
| Potassium Carbonate | 25.0 g | 25.0 g |
| Compound D-8 | 10 m mols | 5 m mols |
| Compound D-5 | 15 m mols | 8 m mols |
| Compound D-7 | 0 m mol | 15 m mols |
| Diethylhydroxylamine | 4.2 g | 4.2 g |
| Fluorescent Whitening Agent (4,4-diaminostilbene series) | 2.0 g | 2.0 g |
| Water to make | 1000 ml | 1000 ml |
| pH (25° C.) | 10.05 | 10.05 |

In this case, the blix solution and the rinse solution were same as in photographic processing (I) in Example 1.

COMPARATIVE EXAMPLE 2 AND EXAMPLE 4

When the light-sensitive materials (101) to (109) in Example 1 were evaluated in the same manner as in Example 1 except that following photographic processing (V-1) for the present invention or (V-2) for comparison was applied in place of photographic processing (I), the results shown in Table 4 below were obtained.

| Processing step | Processing No. (V-1) | Processing No. (V-2) |
|---|---|---|
| Color Development | 48° C. 20 sec. | 35° C. 40 sec. |
| Blix | 38° C. 20 sec. | 38° C. 20 sec. |
| Rinse (1) | 35° C. 7 sec. | 35° C. 7 sec. |
| Rinse (2) | 35° C. 7 sec. | 35° C. 7 sec, |
| Rinse (3) | 35° C. 7 sec. | 35° C. 7 sec, |
| Rinse (4) | 35° C. 7 sec. | 35° C. 7 sec, |
| Rinse (5) | 35° C. 7 sec. | 35° C. 7 sec. |
| Drying | 75° C. 15 sec. | 75° C. 15 sec. |

(As the rinse system, a 5 tank countercurrent system of rinse (5) to rinse (1) was employed.)

The compositions of the processing solutions for aforesaid processing (V-1) were same as those of processing (V-2), and the compositions were as follows.

| Color Developer | |
|---|---|
| Water | 800 ml |
| Ethylenediaminetetraacetic Acid | 2.0 g |
| 5,6-Dihydroxybenzene-1,2,4-trisulfonic Acid | 0.3 g |

-continued

| | |
|---|---|
| Triethanolamine | 8.0 g |
| Sodium chloride | 1.4 g |
| Potassium Carbonate | 25 g |
| Compound D-8 | 5.0 g |
| Diethylhydroxylamine | 4.2 g |
| Fluorescent Whitening Agent (4,4'-diaminostilbene series) | 2.0 g |
| Water to make | 1000 ml |
| pH (25° C.) | 10.05 |
| Blix Solution | |
| Water | 400 ml |
| Ammonium Thiosulfate (70%) | 100 ml |
| Sodium Sulfite | 17 g |
| Ethylenediaminetetraacetic Acid Iron(III) Ammonium | 65 g |
| Ethylenediaminetetraacetic Acid Disodium | 5 g |
| Glacial Acetic Acid | 9 g |
| Water to make | 1000 ml |
| pH (25° C.) | 5.8 |
| Rinse Solution | |

Rinse Solution

Ion-exchanged water (the content of calcium and magnesium each was less than 3 ppm.)

Other processing conditions not described above were same as in the previous examples.

The results obtained are shown in Table 4 below.

TABLE 4

| Light-Sensitive Material | Sensitivity Reduction by Developing Time Shortening: Processing (V-1) | Processing (V-2) | Remarks |
|---|---|---|---|
| (101) | 29% | 9% | Comparison |
| (102) | 28% | 9% | Comparison |
| (103) | 6% | 6% | Invention |
| (104) | 24% | 8% | Comparison |
| (105) | 5% | 6% | Invention |
| (106) | 7% | 7% | Invention |
| (107) | 20% | 8% | Comparison |
| (108) | 7% | 8% | Invention |
| (109) | 22% | 9% | Comparison |

From the results shown above, it can be seen that the effect of this invention is scarcely obtained with processing (V-2) having a long color developing time. The effect of this invention is first obtained in a short color developing time as in processing (V-1).

EXAMPLE 5

By following the steps for preparing silver halide Emulsion (A-1) except that in the preparation of silver halide emulsion (A-4), 0.001 mg of iridium hexachloride di-potassium salt was added to an aqueous solution (III-b) and further in place of spectral sensitizing dye (V-1), following spectral sensitizing dyes (V-5) and (V-6) were added in the amounts of $1.3\times10^{-4}$ mol and $1.0\times10^{-4}$ mol, respectively, per mol of silver halide, silver halide emulsion (A-10) was prepared.

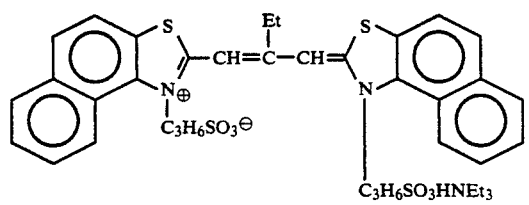

(V-5)

-continued

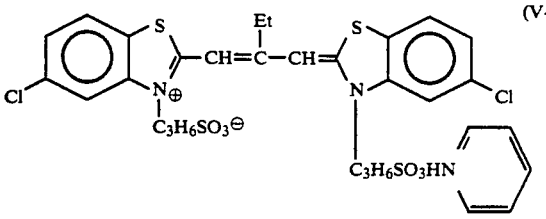

(V-6)

Then, by following the same procedure as in the preparation of silver halide emulsion (B-1) in Example 1 except that in the preparation of silver halide emulsion (B-1), and Fe ion was incorporated in the surfaces of the silver halide grains by the same manner as the preparation of silver halide emulsion (A-4). Also, in this case, 0.0012 mg of iridium hexachloride dipotassium salt was added to aqueous solution (III-b). Further, in place of using spectral sensitizing dyes (V-2) and (V-3), the following spectral sensitizing dye (V-7) was added in an amount $4.5\times10^{-5}$ mol per mol of silver halide. Thus, silver halide emulsion (B-2) was prepared.

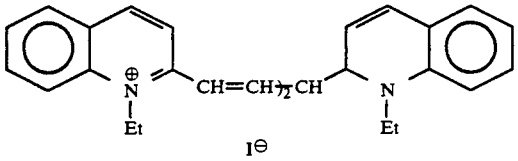

(V-7)

Then, by following the same procedure as the case of preparing silver halide emulsion (C-1) in Example 1 except that in the preparation of silver halide emulsion (C-1), an Fe ion was incorporated in the surfaces of the silver halide grains by the same manner as the case of preparing silver halide emulsion (A-4). Also, in this case, 0.008 mg of iridium hexachloride dipotassium salt was added to aqueous solution (III-b). Further, in place of using spectral sensitizing dye (V-4), the following spectral sensitizing dye (V-8) was added in an amount of $5\times10^{-6}$ mol per mol of silver halide. Thus, silver halide emulsion (C-2) was prepared.

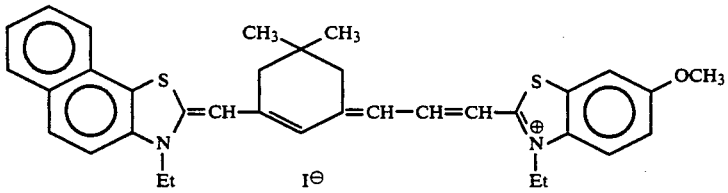

(V-8)

Then, by following the same procedure as in the preparation of light-sensitive material (101) except that the manner of using the silver halide emulsions for the light-sensitive layers was changed as shown in Table 5 below. Further, the following compound was added to layer 3 in an amount of $2.6\times10^{-3}$ mol per mol of silver halide. Thus, light-sensitive material (501) was prepared.

TABLE 5

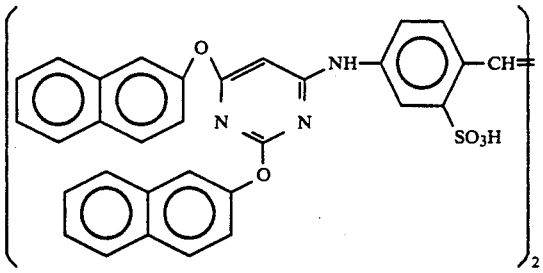

| Layer No. | Amount of silver halide emulsion | |
|---|---|---|
| Layer 1 (yellow coloring) | A-10: | 0.30 g/m$^2$ |
| Layer 3 (magenta coloring) | B-2: | 0.12 g/m$^2$ |
| Layer 5 (Cyan coloring) | C-2: | 0.24 g/m$^2$ |

The light-sensitive material was a color photographic light-sensitive material which was infrared sensitive. The function of each light-sensitive layer is shown in Table 6, in comparison with the light-sensitive layers of light-sensitive material (101).

TABLE 6

| | Light-Sensitive Material (101) | Light-Sensitive Material (501) |
|---|---|---|
| Layer 1 | Blue-sensitive yellow coloring layer | Red-sensitive yellow coloring layer |
| Layer 3 | Green-sensitive magenta coloring layer | Infrared-sensitive magenta coloring layer |
| Layer 5 | Red-sensitive cyan coloring layer | Infrared-sensitive cyan coloring layer |

Other layers of light-sensitive material (501) were same as those of light-sensitive material (101).

Evaluation of Light-Sensitive Material

Light-sensitive material (501) thus prepared was subjected to gradation exposure through each of 3 kinds of color separation filters shown in Table 7 below using a sensitometer (Type FWH, color temperature of light source 3200° K., made by Fuji Photo Film Co., Ltd.). In addition, these filters were interference filters were used.

TABLE 7

| | Peak Wavelength of Transmitted Light | Half Value Width |
|---|---|---|
| (1) Color Separation Filter for Exposing Yellow Coloring Layer | 670 nm | 20 nm |
| (2) Color Separation Filter for Exposing Magenta Coloring Layer | 750 nm | 20 nm |
| (3) Color Separation Filter for Exposing | 810 nm | 20 nm |

TABLE 7-continued

| | Peak Wavelength of Transmitted Light | Half Value Width |
|---|---|---|
| Cyan Coloring Layer | | |

The exposure amount in this case was 500 ergs/cm$^2$ for each material as it passed each of the color separation filters. The exposure time was 0.1 second.

When the light-sensitive material (501) thus exposed was subjected to processing (I) in Example 1, processing (III) in Example 2, and processings (IV-1) and (IV-2) in Example 3 and evaluated as in Example 1, the effect of the image forming process of the present invention was observed as in Examples 1, 2, and 3.

EXAMPLE 6

In the evaluation of the light-sensitive material in Example 5, in place of applying an exposure using the sensitometer, an imagewise exposure was carried out using the semiconductor lasers (hereinafter, each is referred to as LD) shown in Table 8. The exposure in this case was carried out by combining 3 lights obtained from foregoing 3 kinds of LDs into one laser light and scanning exposing the light-sensitive material with the combined laser light using a rotary polyhydron. In this case, each laser light was controlled so that the diameter of the luminence point on the light-sensitive material became about 0.03 mm. Also, the intensity and the exposure time were electrically controlled according to the necessary image density.

The light-sensitive material was imagewise exposed while traveling at a constant speed in a direction perpendicular to the foregoing scanning direction. The time required for the exposure was about 10 seconds for an image of 420 mm×297 mm in area.

When the light-sensitive material (501) thus exposed was subjected to processing (I) in Example 1, processing (III) in Example 3, processing (IV-1) and processing (IV-2) in Example 4, a good image having no unevenness was obtained in each case.

In the example, the exposure wavelength corresponds to the coloring hue as shown in Table 8 below, but the combinations are not inevitable for obtaining the effect of this invention.

TABLE 8

| | Kind of LD | Oscillation wavelength |
|---|---|---|
| (1) LD for exposing yellow coloring layer | AlGaInP | about 670 n.m. |
| (2) LD for exposing magenta coloring layer | GaAlAs | about 750 n.m. |
| (3) LD for exposing cyan coloring layer | GaAlAs | about 810 n.m. |

EXAMPLE 7

Light-sensitive materials (701) and (702) were prepared in the same manner as in the preparation of light-sensitive material (105) except that the total gelatin weight contained in the light-sensitive material was changed as shown in Table 9 below. Then, the light-sensitive materials were evaluated in the same manner as in Example 1. The results are shown in Table 9.

TABLE 9

| Light-Sensitive Material | Total Gelatin Weight | Sensitivity Reduction by Developing Time Shortening | Remarks |
|---|---|---|---|
| (105) | 6.04 g/m$^2$ | 4% | Invention |
| (701) | 8.00 g/m$^2$ | 15% | Comparison |
| (702) | 10.00 g/m$^2$ | 27% | Comparison |

As is clear from the results, when the total gelatin weight of the color photographic material is 7 g/m$^2$ or less, the effect of this invention is obtained.

As described above, according to the present invention, preferred color images can ba stably obtained when carrying out the development of a very short time. Also, the color development proceeds quickly and the material is saturated. The time dependence of the coloring density before and after a definite development time is low (the development processing character is good), whereby stable color images having less uneven density can be obtained.

While the invention has been described in detail and with reference to specific embodiments thereof, it will be apparent to one skilled in the art that various changes and modifications can be made therein without departing from the spirit and scope thereof.

I claim:

1. A color image forming process comprising the step of color developing an imagewise exposed silver halide color photographic material with a developer containing an aromatic primary amine color developing agent, followed by successive steps of desilvering, washing and/or stabilizing, and drying, wherein said color photographic material has at least one silver halide emulsion layer containing silver halide grains containing substantially no silver iodide and containing at least 95 mol % silver chloride based on the total silver halide content, said silver halide grains having a surface phase and an inside phase and further containing from $1\times10^{-6}$ to $1\times10^{-3}$ mol of an iron compound per mol of silver and said iron compound being distributed at an iron ion concentration in the surface phase of the grain of at least 5 times that in the inside phase of the grain, wherein the total gelatin weight of said color photographic material is 7 g or less per m$^2$ of photographic material, and wherein in the color developing step, the color photographic material is processed for a time of from 5 seconds to 30 seconds while striking the surface of a light-sensitive layer of said color photographic material with jet streams of a color developer.

2. The color image forming process of claim 1, wherein the surface phase of the silver halide grains of the silver halide emulsion is not more than 30% by volume of the whole grains and the iron compound concentration in the surface phase is from $1\times10^{-5}$ to $1\times10^{-2}$ mol per mol of silver.

3. The color image forming process of claim 1, wherein the silver halide grains of the silver halide emulsion have on the surface thereof silver bromide-containing localized phases having a silver bromide content of at least 20 mol %.

4. The color image forming process of claim 1, wherein the silver halide grains of the silver halide emulsion contain an iridium ion in an amount of from $1\times10^{-8}$ to $1\times10^{-5}$ mol per mol of silver.

5. The color image forming process of claim 1, wherein the surface phase of the silver halide grains of the silver halide emulsion is not more than 30% by volume of the whole grains and the iron compound concentration in the surface phase is from $1\times10^{-5}$ to $1\times10^{-2}$ mol per mol of silver, and wherein the silver halide grains of the silver halide emulsion have on the surface thereof silver bromide-containing localized phases having a silver bromide content of at least 20 mol %.

6. The color image forming process of claim 1, wherein the surface phase of the silver halide grains of the silver halide emulsion is not more than 30% by volume of the whole grains and the iron compound concentration in the surface phase is from $1\times10^{-5}$ to $1\times10^{-2}$ mol per mol of silver, and wherein the silver halide grains of the silver halide emulsion contain an iridium ion in an amount of from $1\times10^{-8}$ to $1\times10^{-5}$ mol per mol of silver.

7. The color image forming process of claim 1, wherein the silver halide grains of the silver halide emulsion have on the surface thereof silver bromide-containing localized phases having a silver bromide content of at least 20 mol %, and wherein the silver halide grains of the silver halide emulsion contain an iridium ion in an amount of from $1\times10^{-8}$ to $1\times10^{-5}$ mol per mol of silver.

8. The color image forming process of claim 1, wherein the surface phase of the silver halide grains of the silver halide emulsion is not more than 30% by volume of the whole grains and the iron compound concentration in the surface phase is from $1\times10^{-5}$ to $1\times10^{-2}$ mol per mol of silver, wherein the silver halide grains of the silver halide emulsion have on the surface thereof silver bromide-containing localized phases having a silver bromide content of at least 20 mol %, and wherein the silver halide grains of the silver halide emulsion contain an iridium ion in an amount of from $1\times10^{-8}$ to $1\times10^{-5}$ mol per mol of silver.

9. The color image forming process of claim 1, wherein the silver halide grains contain no silver iodide, based on the total silver halide content.

10. The color image forming process of claim 1, wherein the silver halide grains contain at least 98 mol % silver chloride, based on the total silver halide content.

11. The color image forming process of claim 1, wherein the iron compound is a member selected from the group consisting of hexacyano iron(II) acid salts, hexacyano iron(III) acid salts, ferrous thiocyanates, and ferric thiocyanates.

12. The color image forming process of claim 1, wherein the content of said iron compound is from $1\times10^{-5}$ to $5\times10^{-4}$ mol per mol of silver of the silver halide grains.

13. The color image forming process of claim 1, wherein the silver halide grains of the silver halide emulsion contain an iridium ion in an amount of from $5\times10^{-8}$ to $5\times10^{-6}$ mol per mol of silver.

14. The color image forming process of claim 1, wherein the color development time is from 5 to 20 seconds.

15. The color image forming process of claim 1, wherein the rate of the jet stream striking the light-sensitive emulsion layer is in the range of from 0.3 to 3 meters per minute.

16. The color image forming process of claim 1, wherein the streaming amount of the color development processing solution at the jet stream is at least 0.5 liter per minute for the photographic material having a width of 30 cm.

17. The color image forming process of claim 1, wherein the total gelatin weight of said color photographic material is 2 to 7 g per $m^2$ of photographic material.

18. The color image forming process of claim 1, wherein the surface phase of the silver halide grains has an iron concentration at least ten times that of the inside phase of the silver halide grains.

* * * * *